US012595601B2

(12) United States Patent
Ebina et al.

(10) Patent No.: US 12,595,601 B2
(45) Date of Patent: Apr. 7, 2026

(54) FABRIC, AND FIBER PRODUCT

(71) Applicant: Murata Manufacturing Co., Ltd., Nagaokakyo (JP)

(72) Inventors: Ryosuke Ebina, Osaka (JP); Shuichi Nakanishi, Nagaokakyo (JP); Kenichiro Takumi, Nagaokakyo (JP); Mei Watanabe, Nagaokakyo (JP); Masayuki Tsuji, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 423 days.

(21) Appl. No.: 18/173,103

(22) Filed: Feb. 23, 2023

(65) Prior Publication Data

US 2023/0243076 A1 Aug. 3, 2023

Related U.S. Application Data

(63) Continuation of application No. PCT/JP2021/035689, filed on Sep. 28, 2021.

(30) Foreign Application Priority Data

Sep. 29, 2020 (JP) ..... 2020-164052

(51) Int. Cl.
*D04B 39/00* (2006.01)
*D04B 1/16* (2006.01)

(52) U.S. Cl.
CPC ..... *D04B 39/00* (2013.01); *D04B 1/16* (2013.01); *D10B 2331/04* (2013.01);
(Continued)

(58) Field of Classification Search
None
See application file for complete search history.

(56) References Cited

U.S. PATENT DOCUMENTS 5,250,351 A * 10/1993 Kondou ..... D04B 21/18 8/149.1
2014/0310983 A1* 10/2014 Tamm ..... A43B 23/0245 36/83

(Continued)

FOREIGN PATENT DOCUMENTS

JP 2002309466 A 10/2002
JP 2009256838 A * 11/2009

(Continued)

OTHER PUBLICATIONS

Machine Translation JP2009256838 (Year: 2009).*

(Continued)

*Primary Examiner* — Jennifer A Steele
(74) *Attorney, Agent, or Firm* — ArentFox Schiff LLP

(57) ABSTRACT

A fabric that includes a loop of a yarn including a voltage generating filament. The fabric has a value of X of 1,000 or more, where X=(A+B)×C×D×E, and wherein: A is a loop angle of the loop of the yarn when the fabric is stretched by 10%, B is a connection angle of the loop of the yarn when the fabric is stretched by 10%, C is a number of the loops of the yarn per 1 $cm^2$ of the fabric, D is a force (N) applied per basis weight ($g/m^2$) of the fabric, and E is a surface potential (V) of the yarn.

18 Claims, 11 Drawing Sheets

(52) U.S. Cl.
CPC .... *D10B 2401/061* (2013.01); *D10B 2401/13* (2013.01); *D10B 2401/16* (2013.01)

(56) References Cited

U.S. PATENT DOCUMENTS

| | | | | |
|---|---|---|---|---|
| 2015/0376821 | A1* | 12/2015 | McMaster ..... | D04B 1/14 66/202 |
| 2018/0108826 | A1 | 4/2018 | Tajitsu et al. | |
| 2019/0038787 | A1 | 2/2019 | Ando | |
| 2019/0281820 | A1* | 9/2019 | Usui ..... | A01N 25/34 |
| 2019/0330771 | A1 | 10/2019 | Takumi et al. | |

FOREIGN PATENT DOCUMENTS

| | | | |
|---|---|---|---|
| JP | 2018129516 | A | 8/2018 |
| JP | 6428979 | B1 | 11/2018 |
| JP | 2019033709 | A | 3/2019 |
| JP | 6521208 | B1 | 5/2019 |
| JP | 2019179877 | A | 10/2019 |
| WO | 2018235965 | A1 | 12/2018 |
| WO | 2019239866 | A1 | 12/2019 |

OTHER PUBLICATIONS

International Search Report in PCT/JP2021/035689, mailed Dec. 14, 2021, 3 pages.

Takaki, K., "Agricultural and Food Processing Applications of High-Voltage and Plasma Technologies," J. HTSJ, Jul. 2012, vol. 51, No. 216, pp. 64-69.

Microbial Control—Science and Engineering published by Kodansha Ltd, Copyright T. Tsuchido, H. Kourai, H. Matsuoka, J. Koizumi, 2002; "Electrical Control" Section 4.1.3, (Translation of section 4.1.3, p. 50-53).

Yoshida et al., "A Study of Mechanism of High Piezoelectric Performance Poly (lactic acid) Film Manufactured by Solid-State Extrusion," J. Inst. Electrostat. Jpn., 2016, vol. 40, No. 1, pp. 38-43.

* cited by examiner

FABRIC, AND FIBER PRODUCT

CROSS REFERENCE TO RELATED APPLICATIONS

The present application is a continuation of International application No. PCT/JP2021/035689, filed Sep. 28, 2021, which claims priority to Japanese Patent Application No. 2020-164052, filed Sep. 29, 2020, the entire contents of each of which are incorporated herein by reference.

FIELD OF THE INVENTION

The present invention relates to a fiber product such as a fabric. More specifically, the present invention relates to a fabric that can be made of a yarn containing a potential-generating filament, a fiber product containing such a fabric, and the like.

BACKGROUND OF THE INVENTION

Conventionally, many proposals have been made for fiber products such as fabrics using yarns capable of generating charges by external energy (for example, Patent Document 1 and Patent Document 2).

Patent Document 1: JP-B2-6521208

Patent Document 2: WO 2018/235965 A

SUMMARY OF THE INVENTION

The inventors of the present application have noticed that conventional fiber products have problems to be overcome, and have found a need to take measures therefor. Specifically, the inventors of the present application have found that there are the following problems.

For example, Patent Document 1 discloses an antibacterial yarn including a core yarn having a functional polymer that generates a charge by external energy and a sheath yarn having higher hygroscopicity than the core yarn covering at least a part of the core yarn (see claim 1 of Patent Document 1). Further, Patent Document 1 discloses an antibacterial fabric including such antibacterial yarns (see FIG. 1 of Patent Document 1).

Patent Document 2 discloses a knitted cloth having a charge generation region knitted with a charge generation yarn that generates a charge by external energy (see claim 1 of Patent Document 2). Furthermore, Patent Document 2 discloses fiber products such as legwear including such a knitted cloth (see FIG. 1 of Patent Document 2).

Conventional fiber products disclosed in Patent Document 1, Patent Document 2, and the like can exhibit a certain level of antibacterial properties by using a yarn that generates a charge by external energy.

However, it has been found that in conventional fiber products, sufficient antibacterial properties may not be obtained when the product is applied to a place where bacteria easily propagate or a source of odor, particularly when the product is applied to an armpit portion of undershirt or a sole portion of socks. In addition, since clothing such as undershirt and socks may require comfort at the time of wearing, further improvement of wearing comfort as well as antibacterial properties has been required.

The present invention has been made in view of such problems. That is, a main object of the present invention is to provide a fiber product such as a fabric having more improved antibacterial properties and more improved wearing comfort.

The inventors of the present application have attempted to solve the above problem by addressing the problem in a new direction instead of addressing the problem in an extension of the conventional technique. As a result, the present inventors have reached an invention of a fiber product such as a fabric that has achieved the above main object.

In a fiber product using a yarn that generates a charge by external energy, for example, a charge can be generated by application of an external force such as tension. When an electric field can be formed by such electric charges, an effect such as antibacterial properties can be obtained in a fiber product. Therefore, the inventors of the present application particularly paid attention to such a portion where the external force concentrates in the fiber products.

For example, it has been found that an external force such as a tension tends to concentrate on an entangled portion of a loop included in a knitted fabric or the like that can be used for clothing such as undershirt and socks. The loop portion of such a yarn can also impart stretchability to a fiber product. Therefore, the inventors of the present application considered that such a loop portion can greatly contribute to the antibacterial properties and wearing comfort of a fiber product.

The inventors of the present application particularly focused on the loop portion of the yarn included in such a fiber product, and conducted further research.

As a result of intensive studies, the inventors of the present application have found that there is a certain correlation in the number of loops of a loop portion of a yarn that can be included in a fiber product, the angle of the loop, a force that can be applied to the fiber product, the surface potential that can be generated in the yarn, and the like. Furthermore, the inventors of the present application have found that the antibacterial properties and wearing comfort exhibited by the fiber product can be further improved from such a correlation.

According to the present invention, there is provided a fabric comprising a loop of a yarn containing a potential generating filament, and the fabric has a value of X of 1,000 or more, where:

$$X=(A+B)\times C\times D\times E$$

wherein:

A is a loop angle of the loop of the yarn when the fabric is stretched by 10%,

B is a connection angle of the loop of the yarn when the fabric is stretched by 10%, C is number of the loops of the yarn per 1 $cm^2$ of the fabric, D is a force (N) applied per basis weight ($g/m^2$) of the fabric, and E is a surface potential (V) of the yarn.

Hereinafter, the above formula may be referred to as "formula (I)".

In the present invention, fiber products such as a fabric exhibiting more improved antibacterial properties and more improved wearing comfort are obtained. Note that the effects described in the present specification are merely examples and are not limited, and additional effects may be provided.

DESCRIPTION OF THE PREFERRED EMBODIMENTS OF THE INVENTION

Figure 1A:
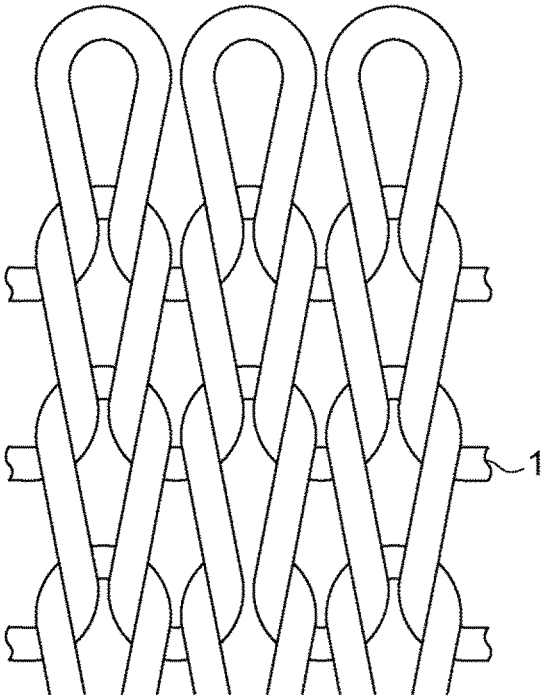
FIGS. 1A and 1B are schematic views schematically illustrating a part of a fabric containing a loop.

The present invention relates to a fabric and a fiber product. Specifically, the present invention relates to a fabric containing a yarn containing a potential generating filament (hereinafter, referred to as "fabric of the present disclosure") and a fiber product containing the fabric of the present disclosure (hereinafter referred to as "fiber product of the present disclosure"). The fabric of the present disclosure is characterized in that a value of "parameter X" described in detail below is "1,000 or more". In addition, in the present disclosure, the term "fabric" and the term "cloth" are used with substantially the same meaning as each other.

[Basic Configuration of Fabric of Present Disclosure]

The fabric of the present disclosure is a sheet-like structure containing a "yarn containing a potential generating filament" (hereinafter, the yarn may be referred to as a "yarn of the present disclosure" or may be simply referred to as a "yarn" for short) described in detail below, or a sheet-like structure that can be configured from the yarn of the present disclosure.

In the present disclosure, "sheet-like" or "sheet" means a shape formed by two main surfaces being configured to be positioned parallel to each other.

The fabric of the present disclosure may include loops of a yarn. In the present disclosure, the "loop" generally means a portion where a yarn is curved. A part of the loop may form a ring or the like.

The fabric of the present disclosure is preferably a knitted fabric. However, the fabric of the present disclosure should not be construed as limited to a knitted fabric.

In the present disclosure, a "knitted fabric" means a sheet-like structure having a structure having a texture formed by connecting a plurality of loops to each other, that is, a knit structure. For example, a knitted fabric can be knitted by forming a loop (for example, a ring-shaped portion) of yarn and continuously hooking the next loop on the loop to form a surface or a texture. The knitted fabric may more particularly have texture that may be formed by knitting such as horizontal knitting, warp knitting, circular knitting, tubular knitting or sock knitting. Such knitted fabrics also include tricot and the like. The knitted fabric of the present disclosure also includes sewn products such as a cut sew and a knit saw. Furthermore, a seamless product such as WHOLEGARMENT is also included in the knitted fabric of the present disclosure (WHOLEGARMENT (registered trademark)).

Examples of the texture that can be included in the knitted fabric of the present disclosure include, but are not limited to, textures such as plain stitch (flat knitting, also referred to as knitting), bare plain stitch, plating plain stitch, smooth (also referred to as interlock), moss stitch (front moss, back moss), knit miss (also referred to as float), honeycomb, thermal (also referred to as waffle), milling, and the like. The texture may be different between the front and back of a knitted fabric. The texture may also contain "tuck". That is, tuck knitting may be used in combination. The texture may contain "miss". The knitted fabric may be a back pile or a back raising. Depending on the texture, the skin touch feeling, air permeability, stretchability and the like of the cloth can be further changed.

In the present disclosure, a texture containing repeating minimal units of "knit", optionally "tuck" and/or "miss", is referred to as a "complete texture".

Such a texture may be formed using a knitting machine or may be formed by hand knitting. When using the knitting machine, the type is not particularly limited, and a conventionally known knitting machine can be used without particular limitation.

(Yarn of Present Disclosure)

The yarn of the present disclosure contains a "potential generating filament" (or fibers capable of forming an electric field or a potential by surface charges, that is, fibers capable of generating a potential), and for example, an electric field is formed by applying an external force in an axial direction of the yarn, and a positive or negative surface potential can be generated. With such a surface potential, for example, effects such as antibacterial properties can be exhibited.

Conventionally, it has been known that proliferation of bacteria, fungi, and the like can be suppressed by an electric field (see, for example, Tetsuaki Tsuchido, Hiroshi Korai, Hideaki Matsuoka, Junichi Koizumi, by Kodansha: Microbial Control—Science and Engineering. In addition, see, for example, Koichi Takagi, Application of High Voltage and Plasma Technology to Agricultural and Food Field, J. HTSJ, Vol. 51, No. 216). In addition, a potential generating the electric field may cause a current to flow through a current path formed by moisture or the like or a circuit formed by a local micro discharge phenomenon or the like. It is considered that this current weakens bacteria and suppresses proliferation of bacteria. Since the yarn of the present disclosure has a potential generating filament capable of generating a charge by energy from the outside, the yarn generates an electric field between fibers or when the yarn approaches an object having a predetermined potential (including a ground potential) such as a human body, and the like. Alternatively, the yarn of the present disclosure allows a current to flow between fibers or when the yarn approaches an object having a predetermined potential (including a ground potential) such as a human body or the like via moisture such as sweat, and the like.

Therefore, the yarn of the present disclosure can exhibit an antibacterial effect for the following reasons, for example. The direct action of an electric field or an electric current generated in the case of application to an object (for example, clothes, footwear, or medical supplies such as masks, and the like) used in proximity to an object having a predetermined potential such as a human body and the like interferes with cell membranes of bacteria and an electron transfer system for maintaining the life of bacteria, and the bacteria are killed or the bacteria themselves are weakened.

Furthermore, oxygen contained in moisture may be changed to active oxygen species by an electric field or a current, or oxygen radicals may be generated in cells of bacteria by a stress environment due to the presence of an electric field or a current, and bacteria are killed or weakened by the action of the active oxygen species containing these radicals. In addition, the above reasons may be combined to cause an antibacterial effect. Furthermore, for the same reason as described above, it is considered that the present invention has a similar effect on viruses. Therefore, in the present disclosure, the antiviral action is also referred to as "antibacterial". However, the term "antibacterial" used in the present disclosure is not limited only to the above theory.

The yarn of the present disclosure may contain a plurality of potential generating filaments. The number of potential generating filaments that can be included in the yarn of the present disclosure is not particularly limited. For example, about 2 or more, 2 to 500, preferably 10 to 350, more preferably 20 to 200 potential generating filaments may be contained in the yarn of the present disclosure.

In the present disclosure, the "potential generation filament" means "Fiber (filament) capable of generating electric charge by external energy to form an electric field or a potential, that is, generating a potential" (hereinafter, it may be referred to as "charge generating fiber").

In the present disclosure, "external energy" includes, for example, an external force (hereinafter, it may be referred to as an "external force"), specifically, a force that causes deformation or strain in the fiber, particularly, a compressive force and/or a force applied in the axial direction of the fiber, and more specifically, external forces such as a tension (for example, a tensile force in the axial direction of the fiber) and/or a stress or a strain force (a tensile stress or a tensile strain on the fiber) and/or a force applied in the transverse direction of the fiber.

As the potential generating filament, for example, a charge generating fiber described in Japanese Patent No. 6428979, and the like may be used.

The dimension (length, thickness (diameter), and the like) and the shape (cross-sectional shape and the like) of the potential generation filament are not particularly limited. The yarn of the present disclosure containing such a potential generating filament may include a plurality of potential generating filaments having different thicknesses.

Therefore, the yarn of the present disclosure may or may not have a constant diameter in the length direction.

The potential generating filament may be a long fiber or a short fiber. The potential generating filament may have a length (dimension) of, for example, 0.01 mm or more. The length may be appropriately selected according to a desired use.

The thickness (diameter) of the potential generating filament is not particularly limited, and may be the same (or constant) or may not be the same along the length of the potential generating filament. The potential generating filament may have a thickness of, for example, 0.001 μm (1 nm) to 1 mm. The thickness may be appropriately selected according to a desired use.

The fiber strength of the potential generating filament is not particularly limited, and may be, for example, 1 cN/dtex to 5 cN/dtex.

The elongation of the potential generating filament is not particularly limited, but may be, for example, 10% to 50%.

The shape, particularly the cross-sectional shape of the potential generating filament is not particularly limited, and the potential generation filament may have, for example, a circular, elliptical, rectangular, or irregular cross section. It is preferable to have a circular cross-sectional shape.

The potential generating filament preferably contains, for example, a material (hereinafter, sometimes referred to as a "piezoelectric material" or a "piezoelectric body") having a piezoelectric effect (or a polarization phenomenon due to an external force) or piezoelectricity (or generates a voltage when a mechanical strain is applied, or conversely generates a mechanical strain when a voltage is applied). Among them, it is particularly preferable to use fibers containing a piezoelectric material (hereinafter, sometimes referred to as "piezoelectric fiber"). Since piezoelectric fibers can form an electric field by piezoelectric, a power supply is unnecessary, and there is no risk of electric shock.

The life of the piezoelectric material that can be contained in the piezoelectric fiber can be maintained longer than the antibacterial effect by a chemical agent or the like, for example. Such piezoelectric fibers are less likely to cause allergic reactions.

The "piezoelectric material" is a material capable of generating a charge by external energy to form an electric field and/or a potential, and for example, any material having the above-described piezoelectric effect or piezoelectricity can be used without particular limitation. The material may be an inorganic material such as piezoelectric ceramics or an organic material such as a polymer.

The "piezoelectric material" (or "piezoelectric fiber") preferably contains a "piezoelectric polymer".

Examples of the "piezoelectric polymer" include a "polymer having pyroelectricity" and a "polymer having no pyroelectricity".

The "polymer having pyroelectricity" generally means a polymeric material that has pyroelectricity and is capable of generating charges (or potentials) on its surface simply by imparting a temperature change. Examples of such a polymer include polyvinylidene fluoride (PVDF), and the like. In particular, one that can generate charges (or potentials) on the surface thereof by thermal energy of the human body is preferable.

The "polymer having no pyroelectricity" generally means a polymer consisting of a polymeric material and excluding the "polymer having pyroelectricity" described above. Examples of such a polymer include polylactic acid (PLA), and the like. As the polylactic acid, for example, poly-L-lactic acid (PLLA) obtained by polymerizing an L-form monomer, poly-D-lactic acid (PDLA) obtained by polymerizing a D-form monomer, and the like are known.

As the polylactic acid (PLA), for example, a copolymer of L-lactic acid and/or D-lactic acid and a compound copolymerizable with the L-lactic acid and/or D-lactic acid may be used.

As the polylactic acid (PLA), a mixture of "polylactic acid (polymer consisting of repeating units substantially derived from monomers selected from the group consisting of L-lactic acid and D-lactic acid)" and "a copolymer of L-lactic acid and/or D-lactic acid and a compound copolymerizable with L-lactic acid and/or D-lactic acid" may be used.

In the present disclosure, the polymer containing polylactic acid is referred to as a "polylactic acid-based polymer". In other words, the "polylactic acid-based polymer" means "polylactic acid (polymer consisting of repeating units substantially derived from monomers selected from the group consisting of L-lactic acid and D-lactic acid)", "a copolymer of L-lactic acid and/or D-lactic acid and a compound copolymerizable with L-lactic acid and/or D-lactic acid", a mixture thereof, or the like.

Among the polylactic acid-based polymers, "polylactic acid" is particularly preferable, and it is most preferable to use a homopolymer of L-lactic acid (PLLA) and a homopolymer of D-lactic acid (PDLA).

The polylactic acid-based polymer may have a crystalline portion. Alternatively, at least a part of the polymer may be crystallized. As the polylactic acid-based polymer, it is preferable to use a polylactic acid-based polymer having piezoelectricity, in other words, a piezoelectric polylactic acid-based polymer, particularly piezoelectric polylactic acid.

Polylactic acid (PLA) is a chiral polymer, and its main chain has a helical structure. Polylactic acid can exhibit piezoelectricity when molecules are uniaxially stretched and oriented. The piezoelectric constant may be increased by further performing heat treatment to increase the crystallinity. In other words, the "piezoelectric constant" can be increased according to the "crystallinity degree" (see "Study on mechanism for developing high voltage electrical conductivity of solid-phase stretched film using polylactic acid", Journal of the Institute of Electrostatics Japan, 40, 1 (2016) 38-43).

The piezoelectric constant of polylactic acid (PLA) is, for example, 5 pC/N to 30 pC/N.

The optical purity (enantiomeric excess (e.e.)) of polylactic acid (PLA) can be calculated by the following formula.

$$\text{Optical purity (\%)}=\{|L\text{-form amount}-D\text{-form amount}|/(L\text{-form amount}+D\text{-form amount})\}\times 100$$

For example, in both the D form and the L form, the optical purity is 90 wt % or more, preferably 95 wt % or more or 97 wt % or more, more preferably 98 wt % to 100 wt %, still more preferably 99.0 wt % to 100 wt %, and particularly preferably 99.0 wt % to 99.8 wt %. The L-form amount and the D-form amount of polylactic acid (PLA) may be, for example, values obtained by a method using high performance liquid chromatography (HPLC).

The degree of crystallinity of polylactic acid (PLA) is, for example, 15% or more, preferably 35% or more, more preferably 50% or more, and still more preferably 55% to 100%. The degree of crystallinity may be as high as possible, but may be, for example, 35% to 50%, and preferably 38% to 50% from the viewpoint of dyeability.

The degree of crystallinity can be determined, for example, by a method using a differential scanning calorimetry (DSC) (for example, DSC 7000 X manufactured by Hitachi High-Tech Corporation), a measurement method such as X-ray diffraction (XRD) (for example, an X-ray diffraction method using ultraX 18 manufactured by Rigaku Corporation), or the like.

The crystal size is not particularly limited, and may be, for example, 5 nm to 20 nm.

The orientation degree is not particularly limited, and may be, for example, 60% to 100%.

In addition to the polylactic acid-based polymer, for example, polymers having optical activity, such as polypeptide-based polymers (for example, poly(γ-benzyl glutarate), poly(γ-methyl glutarate), and the like), cellulose-based polymers (for example, cellulose acetate, cyanoethyl cellulose, and the like), polybutyric acid-based polymers (for example, poly(β-hydroxybutyric acid) or the like), and polypropylene oxide-based polymers, and derivatives thereof may be used as the piezoelectric polymer body.

The yarn of the present disclosure may have a configuration in which as the potential generating filament (or the charge generating fiber), a conductor is used as the core yarn, an insulator (or the filament or the fiber) is wound (covered) around the conductor, and a voltage is applied to the conductor to generate a charge.

The yarn of the present disclosure may be a yarn obtained by simply aligning a plurality of potential-generating filaments (a paralleled yarn or a non-twisted yarn), and may be in the form of a twisted yarn (a twisted combined yarn or a twisted yarn), a crimped yarn (a crimped yarn or a false twisted yarn), or a spun yarn (a spun yarn). The method for aligning the yarns, the twisting method, the crimping method, the spinning method, and the like are not particularly limited, and conventionally known methods can be used.

The yarn of the present disclosure may be a fully oriented yarn (FOY), a partially oriented yarn (POY), a draw textured yarn (DTY), or a covering yarn (filament twisted yarn: FTY). The yarn of the present disclosure may be a single yarn, a two-fold yarn, or a spun yarn.

As the yarn of the present disclosure, for example, the yarns described in Japanese Patent No. 6428979 and Japanese Patent No. 6521208 may be used. Japanese Patent No. 6428979 and Japanese Patent No. 6521208 are incorporated herein by reference.

The yarn of the present disclosure may include other fibers (hereinafter, other fibers except the "potential generating filament" are referred to as "mixed fibers" for convenience). The type of the mixed fiber is not particularly limited, and the mixed fiber may be a fiber made of a synthetic resin; natural fibers such as cotton, ramie (choma hemp), linen (flax), kenaf (henaf hemp), abaca (manilla hemp), henecen (sisal hemp), jute (jute hemp), hemp (cannabis hemp), palm, palm, kouzo (paper mulberry), mitsumata, bagasse, and the like; semi-synthetic fibers (also referred to as regenerated fibers) such as viscose rayon (rayon), Tencel (registered trademark), Lyocell (registered trademark), cupra, Bemberg (registered trademark), and the like. The mixed fiber is preferably a fiber made of a synthetic resin. Alternatively, from the viewpoint of texture feeling, the mixed fiber preferably contains natural fibers.

Examples of the fibers made of a synthetic resin include single fibers made of a polyester-based resin (such as polyethylene terephthalate), single fibers made of a polyolefin-based resin (polyethylene, polypropylene, etc.), single fibers made of a polyamide-based resin (nylon 6, nylon 66, and the like), single fibers of (poly)acrylic made of acrylonitrile, single fibers of engineering plastics (polycarbonate, polyacetal, polystyrene, cyclic polyolefin, and the like), and composite fibers (fiber in which resins of different types or resins composed of different polymer components of the same type are combined).

The yarn of the present disclosure may contain a yarn containing the above-mentioned other fibers (mixed fibers). In this case, the yarn of the present disclosure may be a two-fold yarn or a spun yarn.

The yarn of the present disclosure may contain a loop, and may be appropriately changed or modified as necessary within the scope of the present disclosure.

[Features of Fabric of Present Disclosure]

The fabric the present disclosure is characterized in that a value of "parameter X" indicated by the following formula (I) is "1,000 or more".

$$X=(A+B)\times C\times D\times E \quad \text{(I)}$$

wherein:

A indicates the loop angle of a loop that can be contained in the yarn when the fabric is stretched by 10%, B indicates the connection angle of loops that may be contained in the yarn when the fabric is stretched by 10%, C indicates the number of loops of the yarn per $cm^2$ of the fabric, D indicates a force (N) that can be applied per basis weight ($g/m^2$) of the fabric, and E indicates the surface potential (V) of the yarn.

Figure 1B:
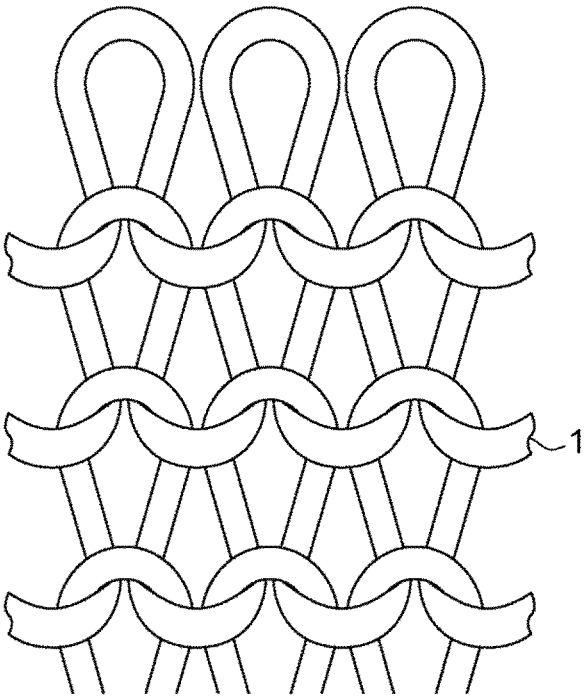

In order to describe the parameter X indicated by the formula (I), for example, FIGS. 1A and 1B show a part of a fabric containing a plurality of loops. The fabric of the present disclosure is not limited to the illustrated aspect.

FIGS. 1A and 1B are schematic views schematically showing a texture of a typical knitted fabric as an example of a fabric of the present disclosure. The fabric shown in FIGS. 1A and 1B is configured by connecting or continuing a plurality of loops made of the yarn 1 to each other. FIG. 1A shows the "front side" of the fabric and FIG. 1B shows the "back side" of the fabric. In accordance with the terminology or convention used in the art, a longitudinal direction along a loop or a vertical direction of a paper surface is referred to as a "wale direction" ($D_w$) (or a loop direction), and a lateral direction or a horizontal direction of the paper surface is referred to as a "course direction" ($D_c$). For convenience of description, the surface illustrated in FIG. 1A is referred to as a "front surface" or a "first surface" of the fabric, and the surface illustrated in FIG. 1B is referred to as a "back surface" or a "second surface" of the fabric. The terms "front surface" and "back surface" of the fabric are formal terms for describing the present invention. The surface ("back surface" or "second surface") shown in FIG. 1B can also be referred to as a "sinker surface" when the fabric is a single knit.

As shown in FIGS. 1A and 1B, a loop facing upward on the paper surface can be referred to as a "needle loop".

Figure 2:
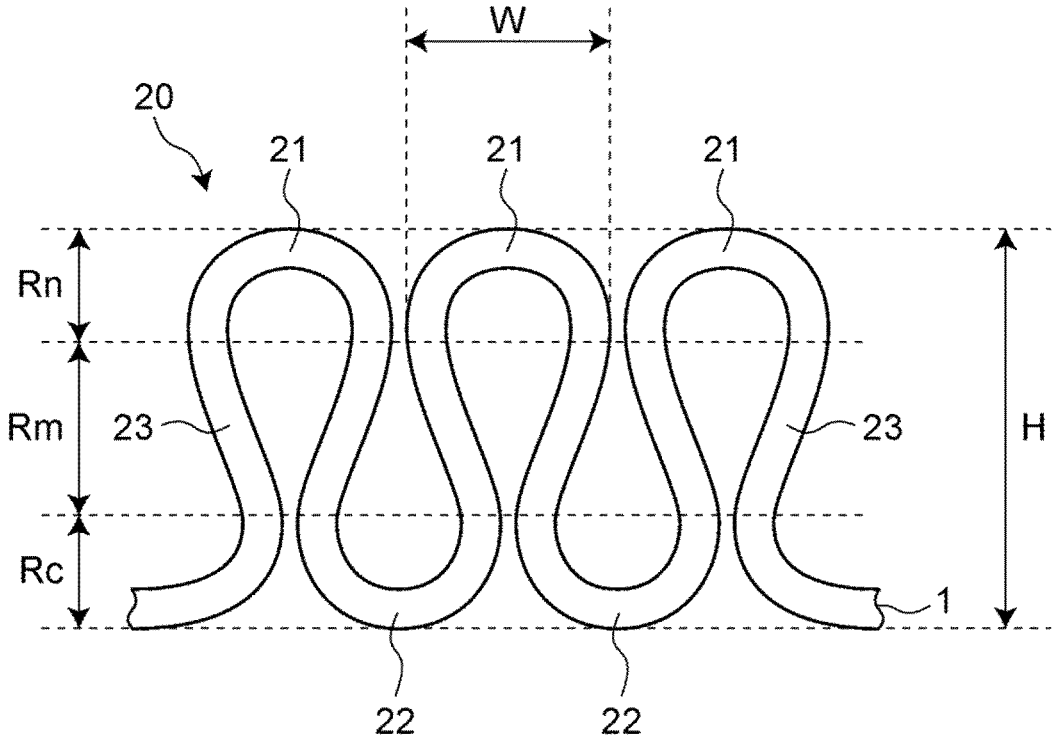
FIG. 2 is a schematic view schematically illustrating a loop.

Next, a plurality of loops that can be included in the yarn 1 illustrated in FIGS. 1A and 1B, for example, will be described in detail with reference to FIG. 2. FIG. 2 illustrates an aspect in which, for example, three of the plurality of loops 20 that may be included in the yarn 1 illustrated in FIGS. 1A and 1B are arranged continuously in the course direction. The loop 20 can be defined by a loop width W and a loop height H.

The loop width W is not particularly limited, and is, for example, 0.2 mm to 2.0 mm.

The loop height H is not particularly limited, and is, for example, 0.2 mm to 2.0 mm.

For convenience of description, the loop 20 will be described separately in an apex region ($R_n$) of the needle loop, an intermediate region ($R_n$), and a connecting portion region ($R_c$) between the loop and the next loop.

The upper portion in the wale direction and containing the ring-shaped apex (or head) of the loop is referred to as an apex region ($R_n$) of the needle loop. In other words, the apex region ($R_n$) of this needle loop is the region through which the needle with the further yarn passes to form the next wale through the ring-shaped apex (or head) of the loop.

A region which is a lower portion in the wale direction and includes a bottom portion (foot portion) or a valley of the loop is referred to as a connecting portion region ($R_c$) between the loop and the next loop. In other words, the connecting portion region ($R_c$) is a region where the bottom portion (foot portion) or the valley of the loop is continuous in the course direction or the horizontal direction of the paper surface.

A region between the apex region ($R_n$) of the needle loop and the connecting portion region ($R_c$) is referred to as an intermediate region ($R_n$). In other words, in the illustrated aspect, the intermediate region ($R_m$) is a region mainly containing a straight line portion or a substantially straight line portion of the yarn 1.

A portion included in the apex region ($R_n$) of the needle loop of the loop 20 of the yarn 1 is referred to as a needle part 21. According to the illustrated embodiment, the needle part 21 can be confirmed on the "back surface" (second surface) of the fabric, for example, visually or with a magnifying glass or a microscope (see FIGS. 1B and 5).

A portion included in the connecting portion region ($R_c$) of the loop 20 of the yarn 1 is referred to as a sinker part 22. In the present disclosure, "sinker" is a term meaning "valley". According to the illustrated form, the sinker part 22 can be confirmed on the "back surface" (second surface) of the fabric, for example, visually or with a magnifying glass or a microscope (see the crescent-shaped or banana-shaped portion of the loop bottom in FIGS. 1B and 5).

A portion included in the intermediate region ($R_m$) of the loop 20 of the yarn 1 is referred to as an Intermediate part 23. According to the illustrated form, the intermediate part 23 can be confirmed on the "front surface" (first surface) of the fabric, for example, visually or with a magnifying glass or a microscope (see FIGS. 1A and 3).

In the present disclosure, "stretching" of a fabric means pulling the fabric in any direction of the fabric (for example, a wale direction and/or a course direction with respect to the loop, etc.) or stretching the fabric. For example, "10% stretch" of a fabric means, for example, that the fabric is stretched by 10% in an arbitrary direction on a length scale by applying a force to the fabric from a state where no force is applied to the fabric. When the fabric includes loops, it is preferable to stretch the fabric in the wale direction. The stretchability of the fabric containing the loop can be confirmed by stretching the fabric in the wale direction.

(Component a of Parameter X)

The component A of the parameter X indicates the "the loop angle of the loop that can be included in the yarn when the fabric is stretched by 10%". When the fabric is a knitted fabric, the loop angle of the component A means an average value of loop angles of loop portions existing in one unit of the fabric, for example, one complete texture of the knitted fabric.

Figure 3:
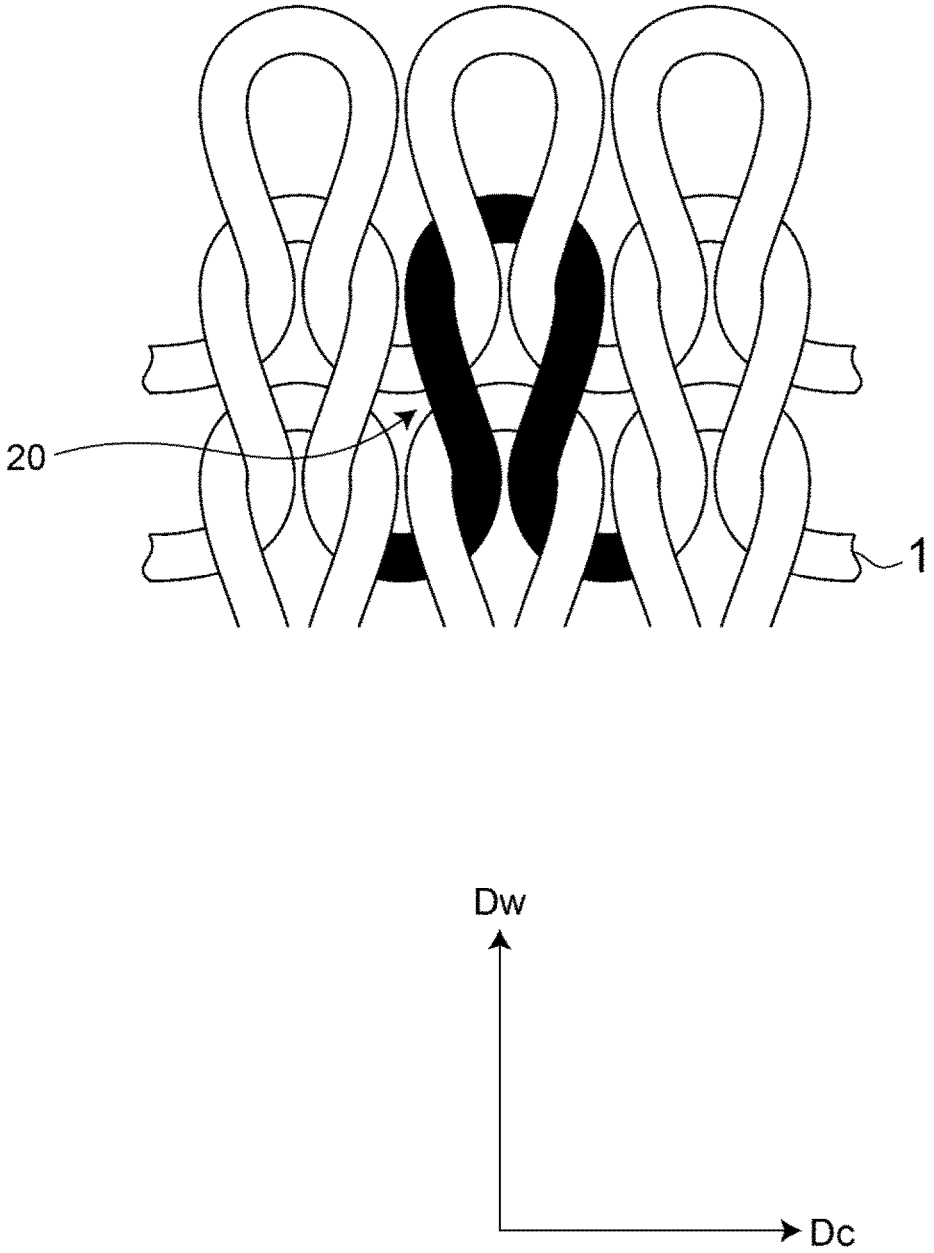
FIG. 3 is a schematic view schematically illustrating a part (front surface) of a fabric containing a loop.

For example, as illustrated in FIGS. 1A, 1B, 3, and 5, the loop 20 of the yarn 1 can be connected to another loop, specifically, a loop of the next wale in the wale direction (vertical direction of the paper surface) (particularly see the loop 20 of FIG. 3).

In the component A, the "loop angle" means, for example, a rising or pulling angle of the loop that can be caused by such loop connection. For example, as shown in FIG. 3, the rising of the loop can be mainly confirmed from the "front surface" (first surface) of the fabric containing the loop (see FIG. 3). The rising of the loop can also be confirmed from the "back surface" (second surface) of the fabric containing the loop (see FIG. 5). The rising of the loop is preferably confirmed from the "front surface" (first surface) of the fabric (see FIG. 3).

Figure 4:
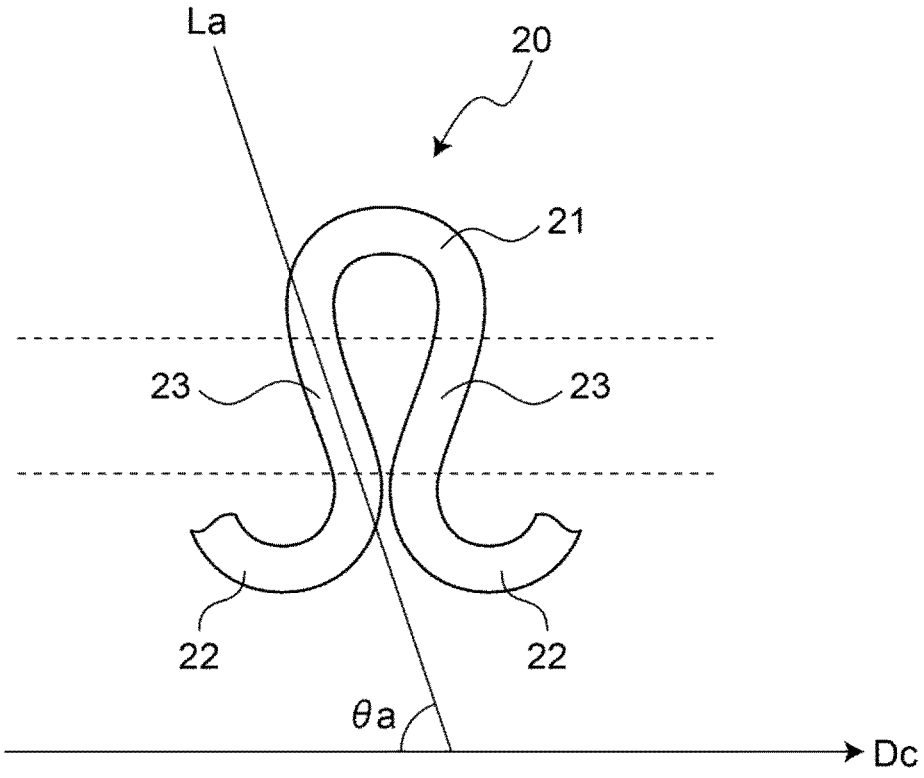
FIG. 4 is a schematic view for explaining a loop angle.

More specifically, as schematically illustrated in FIG. 4, the "loop angle" means an angle $\theta_a$ of a virtual corner portion that can be formed by a straight line $L_a$ along a straight line portion or a substantially straight line portion that can be included in the Intermediate part 23 between the needle part 21 and the sinker part 22 of the loop 20 and a straight line along the course direction $D_c$ (or the horizontal direction of the paper surface). The angle $\theta_a$ is an acute angle.

A smaller value of the angle $\theta_a$ indicates that a round ring-shaped loop close to a circle can be formed. A larger value of the angle $\theta_a$ indicates that the loop rises to form an elongated loop. As described above, the value of the angle $\theta_a$ of the component A is a value that can be involved in the stretchability of the fabric containing the loop. In addition, the value of the angle $\theta_a$ of the component A is a value that can greatly affect the wearing comfort of the fabric containing the loop on the body.

The angle $\theta_a$ of the component A is, for example, a value larger than 0° and smaller than 90°, preferably a value within a range of 5° to 75°. For example, when the fabric is a knitted fabric, the angle $\theta_a$ of the component A is preferably a value when the fabric is stretched by 10% in the wale direction.

The angle $\theta_a$ of the component A can be measured, for example, from a photograph, preferably a micrograph, of the "front surface" (first surface) of the fabric.

The angle $\theta_a$ of the component A is an average value of loop angles of loops that can be included in one unit (for example, one complete texture of a knitted fabric) of the fabric of the present disclosure.

(Component B of Parameter X)

The component B of the parameter X indicates the "connection angle of the loops that can be contained in the yarn when the fabric is stretched by 10%". When the fabric is a knitted fabric, the connection angle of the loops of the component B means an average value of connection angles of loops existing in one unit of the fabric, for example, one complete texture of the knitted fabric.

Figure 5:
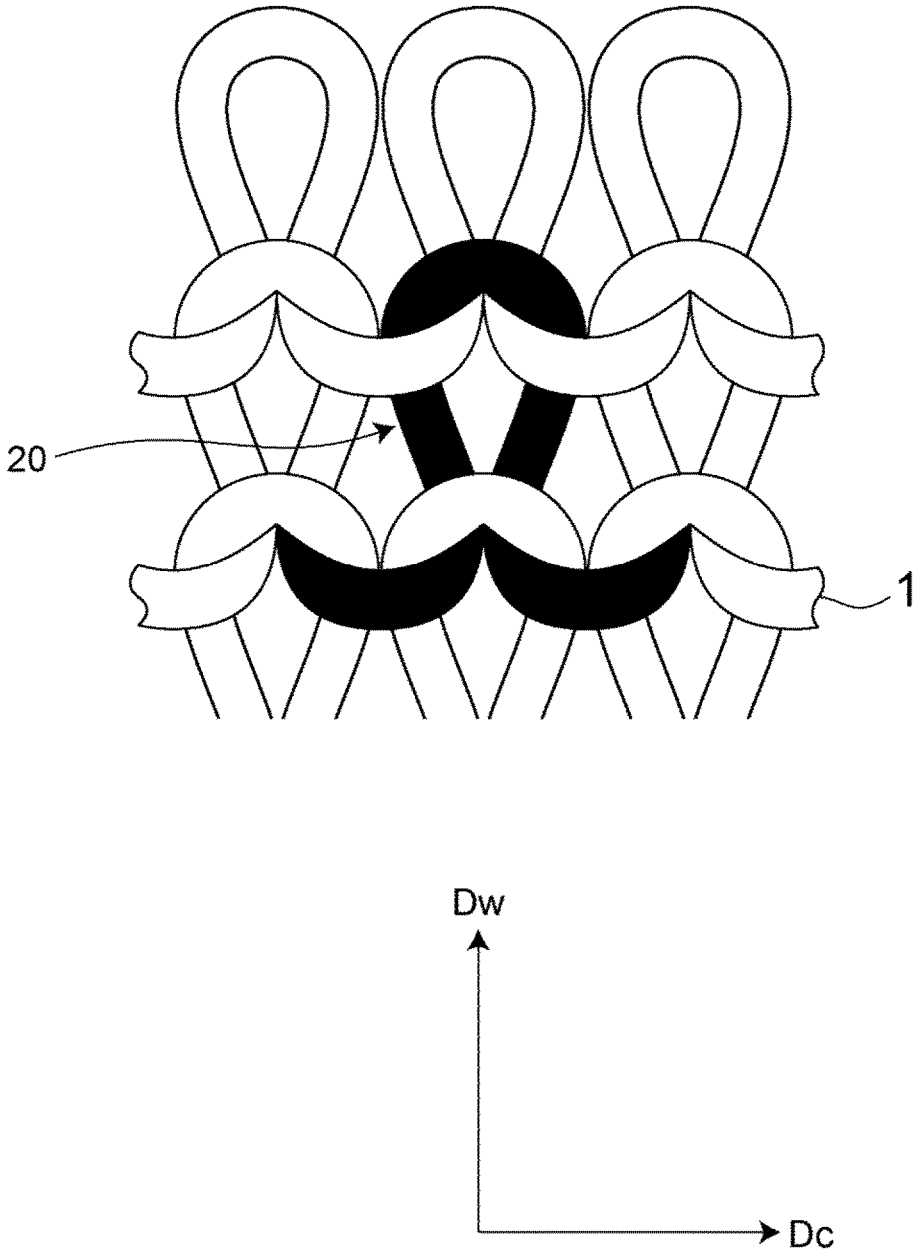
FIG. 5 is a schematic view schematically illustrating a part (back surface) of a fabric containing a loop.

In the component B, the "loop connection angle" means the angle of the loop connection portion, particularly the sinker part. For example, as illustrated in FIG. 5, the sinker part can be mainly confirmed from the "back surface" (second surface) of the fabric containing the loop (see, in particular, the crescent-shaped or banana-shaped portion of the loop bottom of the "back surface" (second surface) shown in FIG. 5). The sinker part of the loop can also be confirmed from the "front surface" (first surface) of the fabric containing the loop (see FIG. 3). It is preferable to check from the "back surface" (second surface) of the fabric (see FIG. 5).

Figure 6:
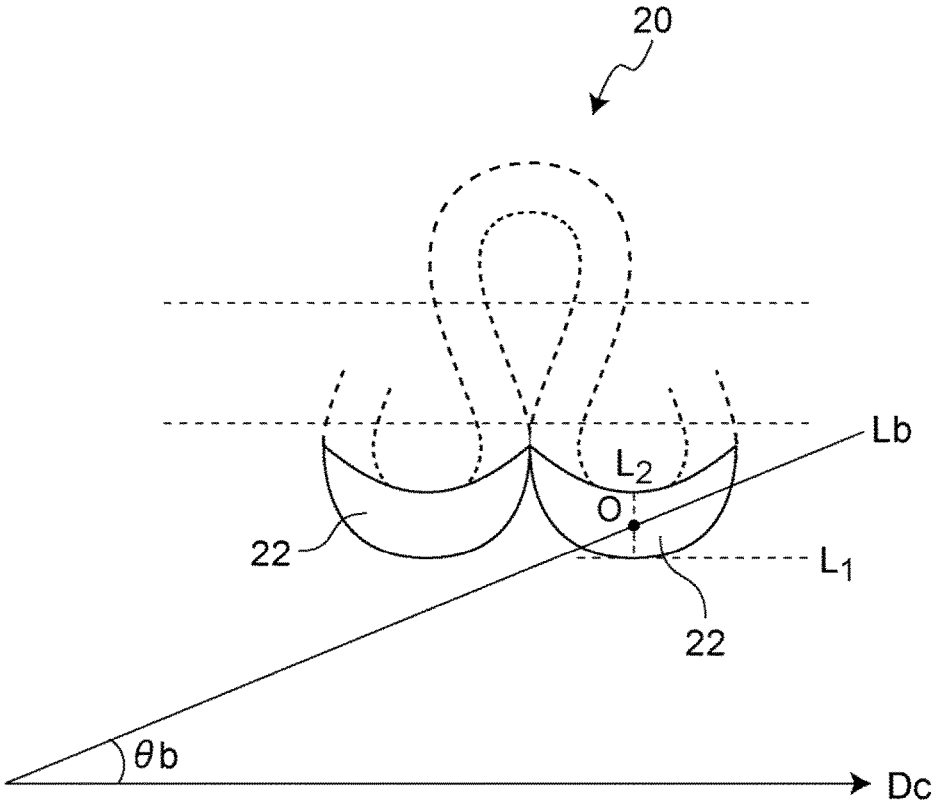
FIG. 6 is a schematic view for explaining a loop connection angle.

More specifically, as illustrated in FIG. 6 in which the loop is viewed from the "back surface" (second surface), the "connection angle of the loop" means an angle $\theta_b$ of a virtual corner portion that can be formed by a straight line $L_b$ along the sinker part 22 of the loop 20 and a straight line along the course direction $D_c$ (or the horizontal of the paper surface). Here, the straight line $L_b$ along the sinker part 22 of the loop 20 may be, for example, a straight line ($L_b$) that passes through the geometric center (for example, the middle point O of the line segment $L_2$ orthogonal to the tangent $L_1$ drawn at the maximum point of the curved portion) of the curved portion (portion having a crescent shape or a banana shape of the illustrated aspect) of the sinker part 22 and substantially follows the shape of the sinker part 22 (see FIG. 6). The angle $\theta_b$ is an acute angle.

The smaller the value of the angle $\theta_b$ is, the more continuous the loop is in the course direction. A larger value of the angle $\theta_b$ indicates that the sinker part 22 of the loop 20 is displaced in the wale direction. Therefore, the value of the angle $\theta_b$ of the component B is a value that can be involved in the stretchability of the fabric containing the loop. In addition, the value of the angle $\theta_b$ of the component B is a value that can greatly affect the wearing comfort of the fabric containing the loop on the body.

The angle $\theta_b$ of the component B is, for example, a value within a range of 0° to 75°, and preferably 5° to 60°. For example, when the fabric is a knitted fabric, the angle $\theta_b$ of the component B is preferably a value when the fabric is stretched by 10% in the wale direction.

The angle $\theta_b$ of the component B can be measured, for example, from a photograph, preferably a micrograph, of the "back surface" (second surface) of the fabric.

The angle $\theta_b$ of the component B is an average value of loop connection angles of loops that can be included in one unit (for example, one complete texture of a knitted fabric) of the fabric of the present disclosure.

Figure 7:
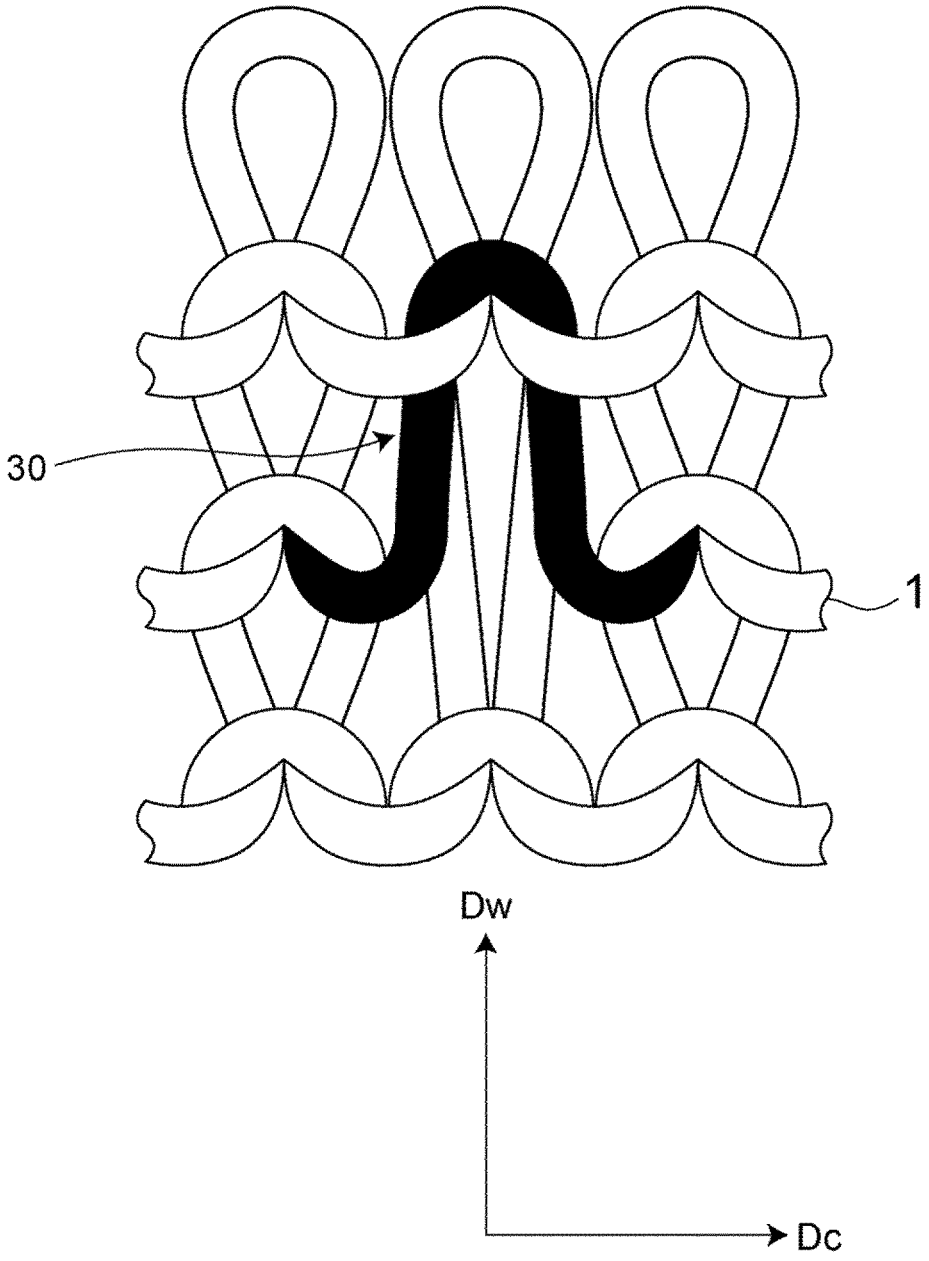
FIG. 7 is a schematic view schematically illustrating another part (back surface) of a fabric containing a loop.
Figure 8:
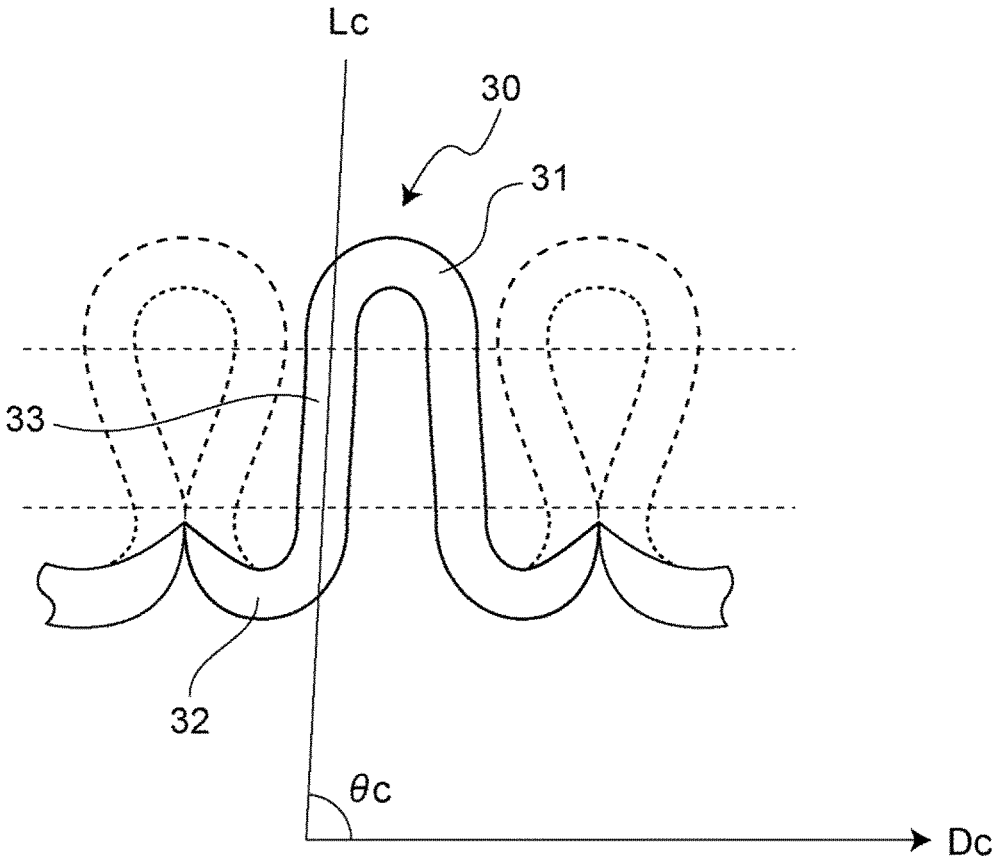
FIG. 8 is a schematic view for explaining the loop illustrated in FIG. 7.

When the fabric is a knitted fabric, for example, as shown in FIG. 7, the connection angle $\theta_b$ of the component B may become significantly large due to tuck knitting or the like. In such a case, for example, as illustrated in FIG. 8, the connection angle $\theta_c$ of a virtual corner portion that can be formed by a straight line $L_c$ along a straight line portion or a substantially straight line portion that can be included in the Intermediate part 33 of the loop 30 and a straight line along the course direction $D_c$ (or the horizontal direction of the paper surface) can be regarded as the connection angle $\theta_b$ of the component B and can be counted. However, the angle $\theta_c$ is an acute angle of less than 90°. At this time, the angle $\theta_b$ of the component B is preferably a value of 45° or less as a whole, that is, as an average value. The angle $\theta_c$ of the loop 30 can also be counted as the loop angle $\theta_a$ of the component A.

The angle $\theta_c$ can be measured as well as the angle $\theta_a$ and the angle $\theta_b$.

Since the component (A+B) included in the parameter X is a component that depends on the angle of the loop, it is a component that can be greatly involved in the stretchability of the fabric containing the loop. As a result, it is a component that can be greatly involved in the chargeability and the like at the time of stretching and contracting of the fabric of the present disclosure in relation to the "potential generating filament" contained in the yarn. The value of the component (A+B) is, for example, a value within a range of 5 to 120. In addition, the component (A+B) is a component that can be greatly involved in the wearing comfort of the fabric containing the loop on the body.

(Component C of Parameter X)

The component C of the parameter X indicates the "number of loops of the yarn per $cm^2$ of the fabric". As the number of loops of the component C, the value of the larger number of loops per 1 $cm^2$ of the "front surface" and the "back surface" of the fabric is adopted.

The number of loops can be calculated from the CPI and WPI of the fabric.

"CPI" indicates the number of courses per inch (in). Note that the number of courses indicates the number of loops in the course direction (horizontal direction or lateral direction).

In the fabric of the present disclosure, the CPI is not particularly limited, and is, for example, within a range of 10 to 150.

"WPI" indicates the number of wales per inch (in). The wale number indicates the number of loops in the wale direction (vertical direction or longitudinal direction).

In the fabric of the present disclosure, the WPI is not particularly limited, and is, for example, within a range of 10 to 100.

Alternatively, the number of loops can also be determined by counting the apex (head) of the ring shape included in the needle part of the loop. In that case, the number of loops can be determined by visual observation or counting from a photograph, preferably a micrograph, of the "front surface" (first surface) or the "back surface" (second surface) of the fabric of the present disclosure.

The "number of loops of the yarn per 1 $cm^2$ of the fabric" of the component C is, for example, a value within a range of 100 to 1500, and preferably 100 to 800.

The component C is a component that can be greatly involved in the stretchability of the fabric. As a result, it is a component that can be greatly involved in the chargeability and the like at the time of stretching and contracting of the fabric of the present disclosure in relation to the "potential generating filament" contained in the yarn. In addition, the component C is a component that can greatly affect the wearing comfort of the fabric containing the loop on the body.

(Component D of Parameter X)

The component D of the parameter X indicates the "force that can be applied per basis weight (unit: $g/m^2$) of the fabric" (unit: Newton (N)).

The value of component D can be determined by measuring the test force (N) of the fabric of the present disclosure with, for example, a universal testing machine. More specifically, the value of component D can be determined by setting a sample of fabric (for example, a sample obtained by stacking 6 layers of fabric, measurement range: 40 mm) in a universal testing machine, measuring the maximum test force (N) applied to the fabric or sample of the present disclosure when the fabric of the present disclosure is stretched over a certain cycle (e.g., 10 cycles) at a certain stretching speed (e.g., 40 mm/min), a certain direction (e.g., the wale direction), and a certain amplitude (e.g., 6.8 mm), and dividing the measured value by the basis weight ($g/m^2$) of the tested fabric. During the measurement, an initial load may be applied to the sample (for example, 0.74 N).

The basis weight of the fabric of the present disclosure is not particularly limited, and is, for example, 10 $g/m^2$ to 300 $g/m^2$.

The test force (N) to be measured is not particularly limited, and is, for example, 1 N to 200 N.

The value of the "force (N) applied per basis weight ($g/m^2$) of the fabric" of the component D is, for example, a value within the range of 0.01 to 1.2, and preferably 0.01 to 1.0.

The component D is a component that can be greatly involved in the stretchability of the fabric. As a result, it is a component that can be greatly involved in the chargeability and the like at the time of stretching and contracting of the fabric of the present disclosure in relation to the "potential generating filament" contained in the yarn. In addition, the component D is a component that can greatly affect the wearing comfort of the fabric containing the loop on the body.

(Component E of Parameter X)

The component E of the parameter X indicates the "surface potential of the yarn" (unit: volt (V)). The surface potential (V) of the yarn of the component E can be measured using, for example, an electrostatic force microscope (EFM), which is a type of scanning probe microscope. The surface potential of the component E means an average value of the surface potentials of the yarns constituting the fabric.

Specifically, first, a sample for surface potential measurement that can be formed by covering "a yarn containing a potential generating filament" contained in the fabric on a core material containing conductive fibers is prepared. Next, the core material is grounded. The surface potential of the sample for surface potential measurement is measured using an electrostatic force microscope (EFM) while the sample is elongated by a predetermined length along a uniaxial direction (specifically, the longitudinal axis direction of the core material). The average value of the surface potentials of the plurality of samples measured in this manner is taken as the surface potential (V) of the component E.

The value of the "surface potential of yarn" of the component E is, for example, a value within a range of 0.1 V or more.

The component E is a component that can be greatly involved in the chargeability and the like at the time of stretching and contracting of the fabric of the present disclosure in relation to the "potential generating filament" contained in the yarn. As a result, it is a component that can be greatly involved in the antibacterial properties exhibited by the fabric.

(Parameter X)

In the fabric of the present disclosure, "parameter X" is a value of "1,000 or more". When the parameter X is 1,000 or more, the fabric of the present disclosure can exhibit wearing comfort as well as antibacterial properties.

The upper limit value of the parameter X is, for example, 100,000 or less, preferably 50,000 or less, and more preferably 40,000 or less. When the parameter X is 100,000 or less, the fabric of the present disclosure can exhibit wearing comfort as well as antibacterial properties.

The parameter X is, for example, a value within a range of 1,000 to 100,000, preferably 1,000 to 50,000, and more preferably 1,000 to 40,000. Within the above range, the fabric of the present disclosure can exhibit more excellent wearing comfort as well as antibacterial properties.

In the present disclosure, "antibacterial" means to suppress or inhibit the development, action or activity of bacteria and/or viruses, etc., to reduce the number of bacteria and/or viruses, etc., or to kill bacteria and/or viruses, etc., and thus kill them, etc.

For example, the "antimicrobial activity value" that can be calculated according to the "bacterial liquid absorption method" among the test methods defined in "Testing methods for antimicrobial properties and antimicrobial effects of fiber products" of "JIS L 1902" is preferably "2.2 or more". The bacterial liquid absorption method is the most common method for testing the antibacterial activity of fiber products (all fiber products, including fabrics, yarns, clothing materials, bedding, household fibers, etc.), and is a test method conforming to the "Antimicrobial/Deodorizing Fiber Product" and "Antibacterially-Treated Fiber Product" certification standards defined by the SEK Mark of Japan Textile Evaluation Technology Council. Here, an antibacterial activity value of "2.2 or more" means an antibacterial activity to such an extent that the product can be certified under the SEK mark for antibacterial and deodorant finishing. In addition, as the test bacteria solution, *Staphylococcus aureus, Klebsiella pneumoniae, Pseudomonas aeruginosa, Escherichia coli, Moraxella* bacteria, MRSA, and the like can be used.

The "antimicrobial activity value" can be generally determined by the following formula.

[Antimicrobial activity value]=[log(arithmetic mean of viable cell counts after 18 hour chamber tensile test)]−[log(arithmetic mean of viable cell counts after 18 hour chamber static test)]

The "chamber tensile test" and the "chamber static test" will be described in detail in the following Examples. As a control (control), a cloth control sample (cotton standard cloth) may be used to calculate the antimicrobial activity value.

In the present disclosure, "wearing comfort" means comfort when the fabric of the present disclosure is applied to or brought into contact with a part of a human body. More specifically, it means that the fabric of the present disclosure has comfort such as moderate stretchability, air permeability that is less likely to steam, and further, smooth tactile sensation.

For example, it can be said that "wearing comfort" is exhibited when moderate stretchability in the case of touching human skin, for example, when the "ratio of expansion and contraction" based on the "tensile strength test" of "JIS L 1096" described in detail below is 10% or more, or when comfort such as moderate air permeability and tactile sensation is exhibited in the case of touching human skin.

More specifically, regarding the stretchability, air permeability, tactile sensation, and the like of the fabric of the present disclosure, in a wearing test in which the fabric of the present disclosure is applied to the bodies (for example, an underarm portion, a sole portion, and the like) of 10 subjects, for example, in a case where 1: very excellent comfort, 2: excellent comfort, 3: normal comfort, 4: poor comfort, 5: very poor comfort is regarded as the evaluation criteria as follows, and in a case where the average score of the evaluation of the 10 subjects is "2.5 or less", it is evaluated that the "wearing comfort" is exhibited.

(Use of Fabric of Present Disclosure)

The fabric of the present disclosure can exhibit both "antibacterial properties" and "wearing comfort". Therefore, the fabric of the present disclosure can be used without particular limitation in the field where such antibacterial properties and wearing comfort are required. For example, it can be used for general fabric products such as clothes. More specifically, the following applications are conceivable.

Examples thereof include clothes (for example, undershirt, socks, underwear, shirts, sportswear, supporters, and the like), footwear (for example, shoes, insoles for boots, and the like), beddings (for example, bedclothes, mattresses, sheets, pillows, pillows covers, and the like), towels, handkerchiefs, general medical supplies (for example, bandages, gauzes, masks, doctor's and patient's clothes, etc.), sanitary supplies, sporting goods (such as glove inners or basket gloves used in martial arts), and the like.

Of the clothing, the undershirt always expands and contracts due to the movement of the wearer, so that the fabric of the present disclosure can generate charges and/or electric potentials with high frequency. In addition, the armpit portion of undershirt or the like absorbs moisture such as sweat and becomes a hotbed for proliferation of bacteria or the like, but the fabric of the present disclosure can suppress at least proliferation of bacteria due to generated charges and/or potentials, and thus can produce a remarkable effect as a bacterium-countermeasure application for odor prevention. Furthermore, the fabric of the present disclosure can exhibit particularly excellent wearing comfort in undershirt.

In addition, since the sock always expands and contracts along the joint by movement such as walking and the like, the fabric of the present disclosure can generate charges and/or potentials at high frequency. In addition, socks, particularly foot sole portions absorb moisture such as sweat and serve as a hotbed for growth of bacteria and the like, but since the fabric of the present disclosure can suppress at least growth of bacteria, it can produce a remarkable effect as a bacterium-countermeasure for odor prevention. Furthermore, the fabric of the present disclosure can exhibit particularly excellent wearing comfort in socks.

Since the fabric of the present disclosure exhibits excellent wearing comfort together with antibacterial properties, it can be used for medical supplies such as bandages, gauzes, masks and clothes of doctors and/or patients.

(Preferred Embodiment of Fabric of Present Disclosure)

In the fabric of the present disclosure, the value of the parameter X is preferably 100,000 or less. When the value of the parameter X is 100,000 or less, electric charges and/or electric potentials can be efficiently generated together with stretchability, and wearing comfort and antibacterial properties suitable for clothing, particularly clothing such as undershirt, socks, underwear, shirts, sportswear, supporters, and the like; and medical supplies such as bandages, gauzes, masks and doctor and/or patient clothing can be exhibited.

The potential generating filament contained in the fabric of the present disclosure preferably contains a piezoelectric material. The piezoelectric material can appropriately generate a surface potential according to expansion and contraction of the fabric.

When the potential generating filament contains a piezoelectric material, the piezoelectric material preferably contains polylactic acid. Polylactic acid appropriately generates a surface potential according to stretching and contraction of a fabric, and can provide a smooth skin touch due to hydrophobicity thereof, and can impart wearing comfort to the fabric.

The fabric of the present disclosure is preferably a knitted fabric. Since the knitted fabric can be composed of a large number of loops, the knitted fabric is excellent in stretchability, skin touch feeling, air permeability, and the like. Therefore, more appropriate wearing comfort can be exhibited together with appropriate antibacterial properties.

The fabric of the present disclosure preferably exhibits antibacterial properties, and more preferably exhibits an antibacterial activity value of 2.2 or more.

The fabric of the present disclosure preferably exhibits wearing comfort, and can be used particularly in clothing such as undershirt, socks, underwear, shirts, sportswear, supporters, and the like, particularly in a portion where bacteria easily propagate and a portion that is a source of odor, particularly in underarm portions of undershirt and shirts, sole portions of socks, and the like. Furthermore, since the fabric of the present disclosure has antibacterial properties together with wearing comfort, the fabric can also be used in medical supplies such as bandages, gauzes, masks, and clothes of doctors and/or patients.

[Fiber Product of Present Disclosure]

Furthermore, the present invention relates to a fiber product containing "the fabric of the present disclosure" described above (hereinafter referred to as "fiber product of the present disclosure").

The fiber product of the present disclosure contains a first fabric and, if necessary, a second fabric.

The first fabric is the "fabric of the present disclosure" described above, that is, the "fabric containing a yarn containing a potential generating filament", and may include loops of such a yarn, and has a value of the parameter X indicated by the following formula (I):

$$X=(A+B)\times C\times D\times E \quad \text{(I)}$$

[wherein A, B, C, D and E are as defined above]

of 1,000 or more.

The second fabric is a fabric having stretchability as necessary.

In other words, the fiber product of the present disclosure can include a combination of the fabric (first fabric) of the present disclosure and a fabric (second fabric) having stretchability as necessary. In addition, other fabrics such as third, fourth, fifth . . . and the like may be included as necessary.

The fiber product of the present disclosure preferably contains at least a first fabric and a second fabric.

(First Fabric)

In the present disclosure, the "first fabric" is the "fabric of the present disclosure" described above, and the fabric of the present disclosure can be used without particular limitation in the fiber product of the present disclosure.

(Second Fabric)

The second fabric may be, for example, a woven fabric, a knitted fabric, a nonwoven fabric, or the like. The second fabric is not particularly limited as long as it contains fibers. The type, shape, thickness, dimension, and the like of the fiber are not particularly limited.

In the present disclosure, the "second fabric" preferably has "stretchability" as necessary. The "stretchability" in the second fabric means a property of stretching, contracting, and preferably returning to an original shape. The "stretchability" of the second fabric may be larger than the stretchability of the first fabric, that is, the fabric of the present disclosure, or may be smaller than the stretchability of the fabric of the present disclosure.

Examples of the index indicating the stretchability of the fabric include "ratio of expansion and contraction" based on "tensile strength test" of "JIS L 1096".

For example, a ratio of expansion and contraction of 50% indicates that when a fabric or a sample of fabric is stretched in a certain direction, the dimension stretches up to 1.5 times. That is, a ratio of expansion and contraction of 50% means a stretch ratio of 150%.

The second fabric preferably has a ratio of expansion and contraction of 40% or more (or a stretch ratio of 140% or more) in the first direction. The first direction may be a warp direction in the case of a woven fabric, and may be a wale direction of a loop in the case of a knitted fabric. The first direction can also be referred to as "longitudinal direction".

The second fabric preferably has, as an upper limit value in the first direction, a ratio of expansion and contraction of, for example, 150% or less (or a stretch ratio of 250% or less).

The second fabric preferably has a ratio of expansion and contraction of 40% or more (or a stretch ratio of 140% or more) in a second direction perpendicular to the first direction. The second direction may be the direction of the weft yarn in the case of a woven fabric, and may be the course direction of the loop in the case of a knitted fabric. The second direction can also be referred to as a "lateral direction".

The second fabric preferably has, as an upper limit value in the second direction, a ratio of expansion and contraction of, for example, 100% or less (or a stretch ratio of 200% or less).

The second fabric may be used in combination with the first fabric, and the second fabric may have a higher ratio of expansion and contraction than the first fabric in any direction. In other words, the first fabric may have a lower ratio of expansion and contraction than the second fabric in any direction.

When the second fabric has higher stretchability and/or ratio of expansion and contraction than the first fabric, or when the first fabric has lower stretchability and/or ratio of expansion and contraction than the second fabric, the fiber product of the present disclosure can exhibit further wearing comfort by the portion of the second fabric. Since the first fabric is the fabric of the present disclosure, the fiber product of the present disclosure can exhibit the above-mentioned antibacterial properties and wearing comfort, thus, can exhibit further additional wearing comfort due to the second fabric.

There is no particular limitation as a means for the second fabric to have higher stretchability, particularly higher ratio of expansion and contraction than the first fabric. For example, an elastic yarn may be used as the yarn that can be contained in the second fabric. When the second fabric is a woven fabric, the desired stretchability may be achieved by adjusting the distance between the warp and the weft or changing the weave method. When the second fabric is a knitted fabric, the desired stretchability may be achieved by adjusting the loop interval or changing the knitting method. When the second fabric is a nonwoven fabric, the desired stretchability may be achieved by adjusting the basis weight, fiber length, fiber diameter, and the like.

Alternatively, the first fabric may have higher stretchability and/or ratio of expansion and contraction in any direction than the second fabric. In other words, the second fabric may have lower stretchability and/or ratio of expansion and contraction of stretch in any direction than the first fabric. When the stretchability and/or the ratio of expansion and contraction of the first fabric is higher than the stretchability and/or the ratio of expansion and contraction of the second fabric, stress can be more efficiently concentrated on the first fabric when the entire fiber product is stretched. As a result, the first fabric can more efficiently exhibit antibacterial properties.

The second fabric may include the above-described "yarn containing a potential generating filament" as the fiber. When the second fabric contains such a yarn, the fiber product of the present disclosure can exhibit further antibacterial properties even in the second fabric in addition to the first fabric portion.

In the fiber product of the present disclosure, the second fabric can be bonded to the first fabric by sewing, for example. The first fabric and the second fabric can also be joined to each other by connecting yarns or weaving or sewing.

Figure 9:
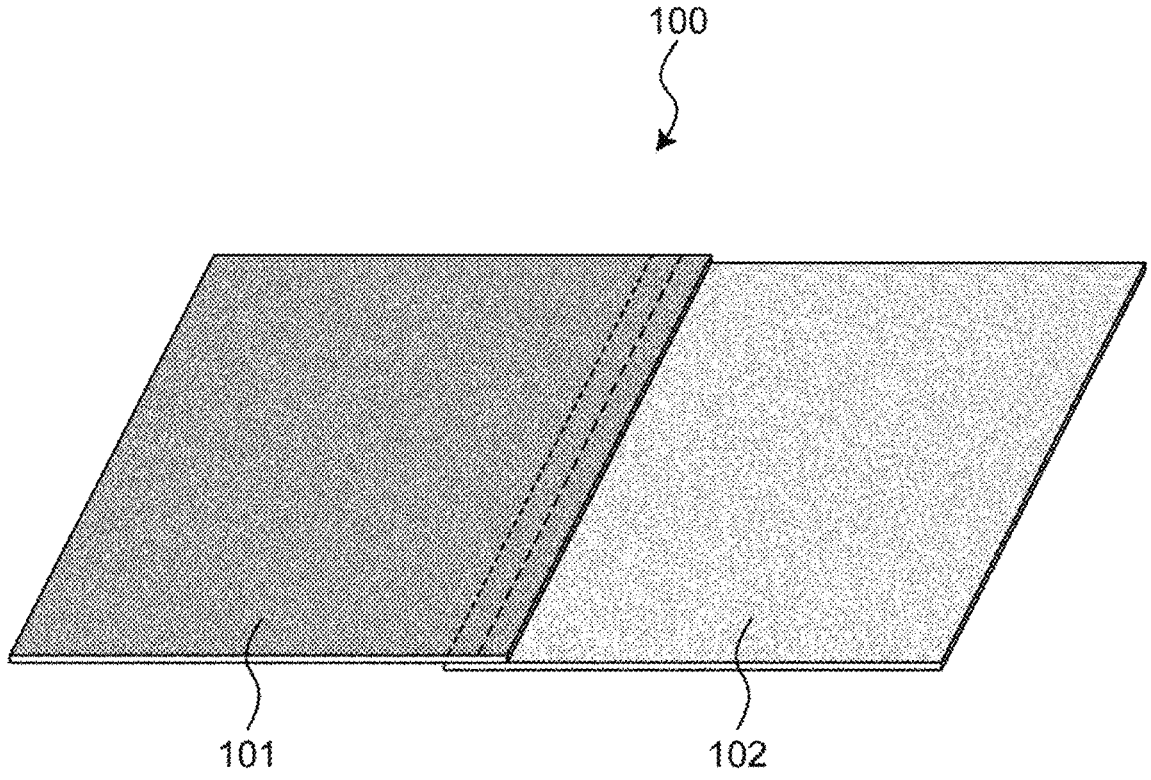
FIG. 9 is a schematic view schematically illustrating a fiber product containing a first fabric and a second fabric.

For example, FIG. 9 schematically illustrates a fiber product 100 of the present disclosure. In the fiber product 100, a first fabric 101 and a second fabric 102 are bonded to each other by sewing, for example. The first fabric 101 and the second fabric 102 are preferably bonded to form a continuous surface.

The second fabric 102 may have higher stretchability and/or ratio of expansion and contraction than the first fabric 101. In other words, the first fabric 101 may have lower stretchability and/or ratio of expansion and contraction than the second fabric 102. Such a second fabric 102 may provide additional wearing comfort.

Alternatively, the first fabric 101 may have higher stretchability and/or ratio of expansion and contraction than the second fabric 102. In other words, the second fabric 102 may have lower stretchability and/or ratio of expansion and contraction of stretch than the first fabric 101. With such a second fabric 102, stress can be more efficiently concentrated on the first fabric 101.

In the present disclosure, the shapes of the first and second fabrics and the number of pieces to be combined are not particularly limited.

Figure 10:
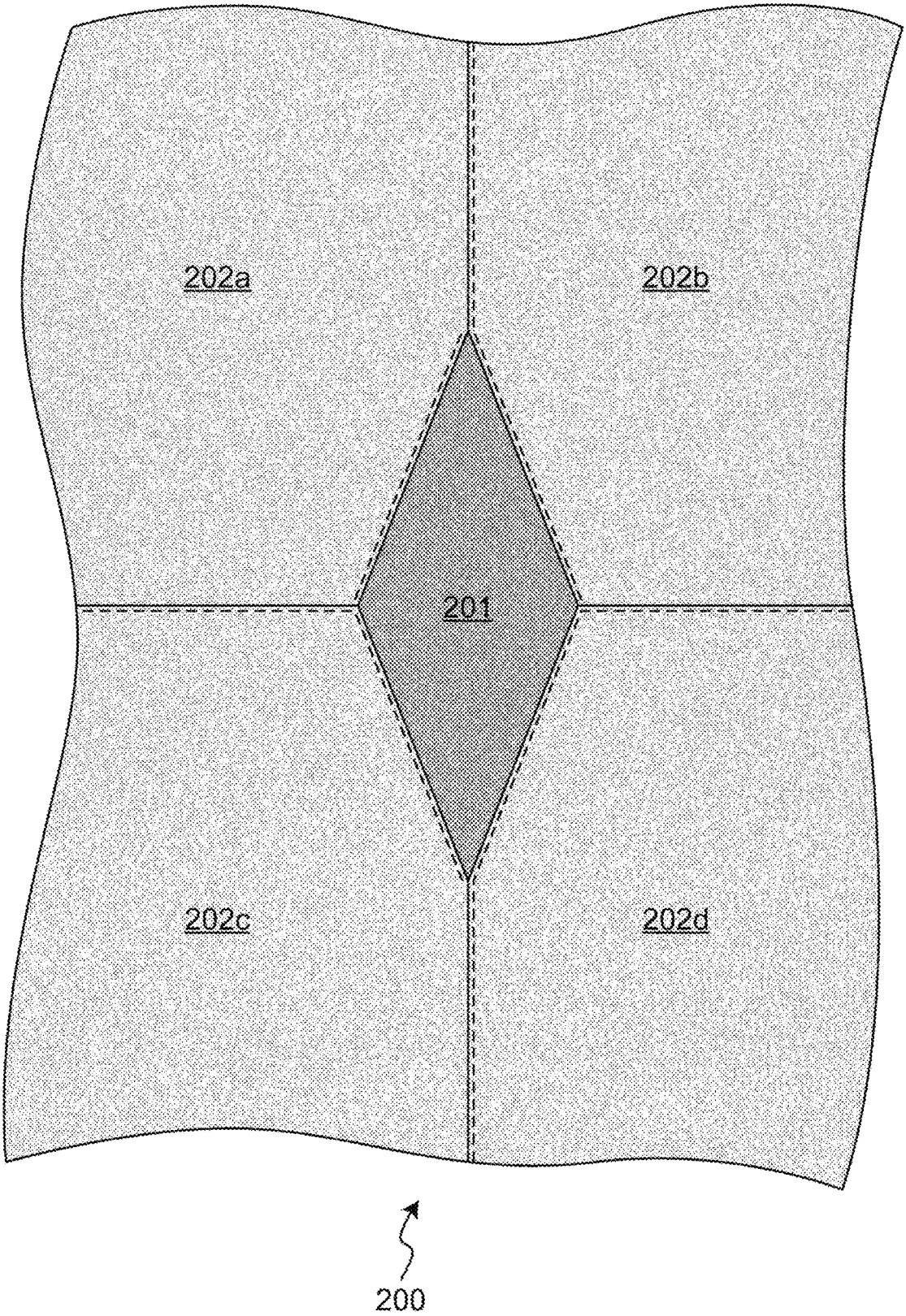
FIG. 10 is a schematic view schematically illustrating another fiber product containing a first fabric and a second fabric.

For example, a fiber product 200 in which one first fabric and four second fabrics are combined is schematically illustrated in FIG. 10.

In the mode illustrated in FIG. 10, four second fabrics 202*a* to 202*d* are arranged around one first fabric 201 and joined by sewing.

When the second fabrics 202*a* to 202*d* have higher stretchability and/or ratio of expansion and contraction than the first fabric 201, such second fabrics 202*a* to 202*d* may provide additional wearing comfort. In other words, since the second fabrics 202*a* to 202*d* expand and contract more than the first fabric 201, more excellent wearing comfort can be exhibited.

When the first fabric 201 has higher stretchability and/or ratio of expansion and contraction than the second fabrics 202*a* to 202*d*, such second fabrics 202*a* to 202*d* allow stress to be more efficiently concentrated on the first fabric 201. In other words, the first fabric 201 expands and contracts more than the second fabrics 202*a* to 202*d*, so that stress can be more efficiently concentrated on the first fabric 201, thereby exhibiting further antibacterial properties.

Figure 11:
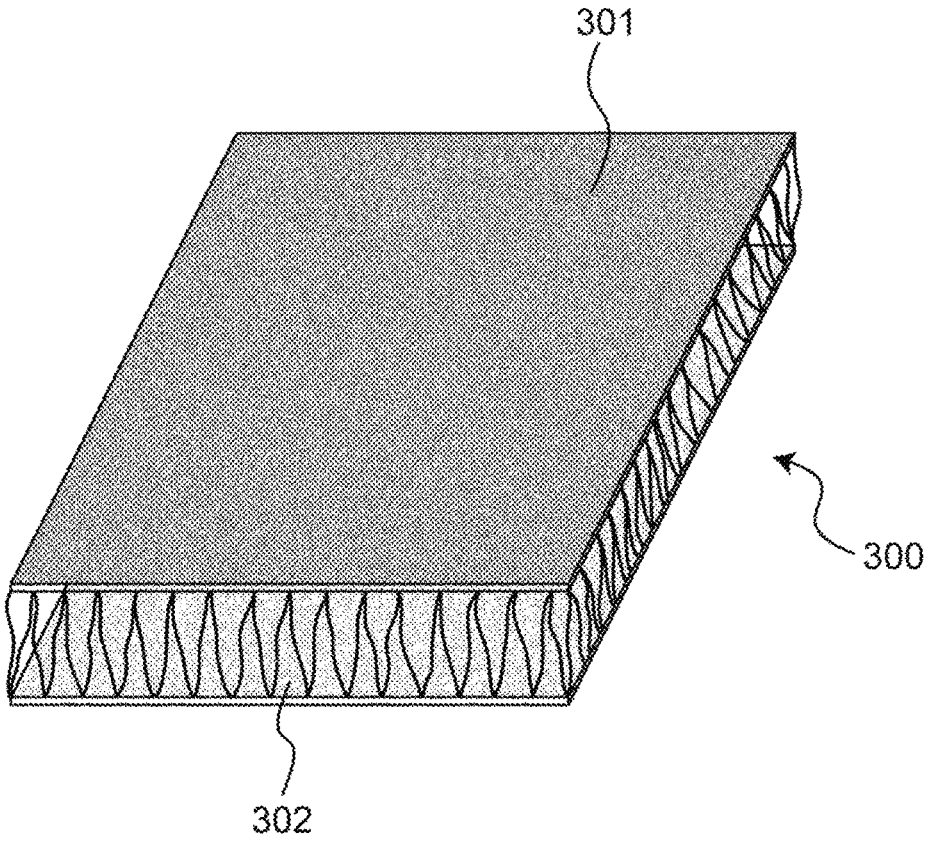
FIG. 11 is a schematic view schematically illustrating another fiber product containing a first fabric and a second fabric.

A fiber product 300 in which a first fabric and a second fabric are bonded to each other by connecting yarns is schematically illustrated in FIG. 11.

FIG. 11 schematically shows a fiber product 300 having a two-layer structure in which a first fabric 301 and a second fabric 302 are bonded to each other by connecting yarns.

The connecting yarns may be present over the entire surface so as to join the respective surfaces together, not only at the edges of the first and second fabrics 301, 302.

The connecting yarn is not particularly limited, and a commercially available yarn, and a yarn that can be contained in the first fabric or the second fabric may be used.

The fiber product 300 may be formed by weaving or sewing.

When the second fabric 302 has higher stretchability and/or ratio of expansion and contraction than the first fabric 201, more efficient concentration of stress on the first fabric 301 can provide additional antimicrobial properties. In other words, by the second fabric 302 stretching and contracting more than the first fabric 301, the first fabric 301 can also stretch and contract together to exhibit further antibacterial properties.

When the first fabric 301 has higher stretchability and/or ratio of expansion and contraction than the second fabric 302, it may exhibit additional wearing comfort along with antibacterial properties. In other words, by the first fabric 301 stretching and contracting more than the second fabric 302, it is possible to exhibit further wearing comfort together with antibacterial properties.

The fabric 301 may be a second fabric and the fabric 302 may be a first fabric.

For this reason, the fiber product of the present disclosure can be used in general fabric products such as clothes similarly to the fabric of the present disclosure. In particular, it is preferable that the first fabric of the fiber product of the present disclosure is applied to a portion where bacteria easily propagate or a portion where an odor is generated, for example, an armpit portion of undershirt or a shirt, a sole portion of a sock, or the like, and the second fabric is applied to other portions.

(Other Fabric)

The fiber product of the present disclosure may contain, for example, a fabric such as a woven fabric, a knitted fabric, or a nonwoven fabric as the third, fourth, fifth . . . fabrics as necessary. These fabrics are not particularly limited as long as they contain fibers. The type, shape, thickness, dimension, and the like of the fiber are not particularly limited. The fiber product of the present disclosure may further include a leather cloth or the like.

The fabric and fiber product of the present disclosure are not limited to those described above. Hereinafter, the fabric and the fiber product of the present disclosure will be described in detail with reference to specific examples, but the present invention is not limited to these examples.

EXAMPLES (Preparation of Yarn)

The following yarns (A) to (N) were prepared.

- Yarn (A): PLA 84 T 72 FOY (manufactured by Teijin Limited)
- Yarn (B): PLA 84 T 72 DTY (manufactured by Teijin Limited)
- Yarn (C): PLA 56 T 72 DTY (manufactured by Teijin Limited)
- Yarn (D): PLA 170 T 144 DTY (manufactured by Teijin Limited)
- Yarn (E): PLA 84 T 24 FOY/2 SZ 500 T two-fold yarn (manufactured by Teijin Limited)
- Yarn (F): PLA FTY (PLA 84 T 72 DTY/PU 44 T1) (manufactured by Teijin Limited) (Using PU 44 T1 (manufactured by Asahi Kasei Corporation) as a core yarn, a covering yarn of PLA 84 T 72 DTY was produced using an Italian twisting machine.)
- Yarn (G): PET 84 T 72 DTY (manufactured by Teijin Limited)
- Yarn (H): nylon wooly yarn 78 T 72 (manufactured by Teijin Limited)
- Yarn (I): PET 170 T 144 DTY (manufactured by Teijin Limited)
- Yarn (J): PET FTY (PET 84 T 72 DTY/PU 44 T1) (manufactured by Teijin Limited)
- Yarn (K): TERAMAC 84 T 36 DTY (manufactured by Unitika Ltd.)
- Yarn (L): Bemberg FB 84 T 45 (manufactured by Asahi Kasei Corporation)
- Yarn (M): 60 count cotton spun yarn
- Yarn (N): 30 yarn count cotton spun yarn
- PLA: polylactic acid-based yarn (yarn containing piezoelectric polylactic acid)
- PET: polyethylene terephthalate-based yarn
- PU: polyurethane-based yarn

Example 1

Yarn (B): Using PLA 84 T 72 DTY (manufactured by Teijin Limited), a knitted fabric with a smooth texture was produced by a double circular knitting machine (28 G) according to the conditions shown in Table 1, dyed under the condition of 110° C., and then subjected to a dry heat setting under the condition of 140° C.

Examples 2 to 23, and Comparative Examples 1 to 10

In the same manner as in Example 1, fabrics of Examples 2 to 23 and Comparative Examples 1 to 10 were prepared according to the conditions shown in Tables 1 to 3 below.

The "antimicrobial activity value" and "wearing comfort" of each fabric can be determined according to the following procedure. The results are shown in Tables 1 to 3 below.

[Antimicrobial Activity Value of Fabric]

The antibacterial activity value of a fabric can be determined according to the "bacterial liquid absorption method" among the test methods defined in "Testing methods for antibacterial property and antibacterial effects of fiber products" of "JIS L 1902". Specifically, the antimicrobial activity value can be determined based on the following formula.

[Antimicrobial activity value]=[log(arithmetic mean of viable cell counts after 18 hour chamber tensile test)]−[log(arithmetic mean of viable cell counts after 18 hour chamber static test)]

The "chamber tensile test" and the "chamber static test" are as follows.

(Chamber Tensile Test)

For example, in accordance with the apparatus and method described in JP-A-2019-33709, a test was performed under the following conditions, a change in the number of bacteria after 18 hours was examined, and an arithmetic mean of the number of viable bacteria was determined.

Expanding and Contracting Condition

Samples (12 layers): Folded to form a 12 layer looped sample (30 mm width, 60 mm length).

Initial load: 150 g

Amplitude: 10 mm

Expansion and contraction repetition frequency: 3 Hz (Chamber Static Test)

A sample was set under the conditions conforming to the chamber tensile test, and the test was performed under the condition of not giving expansion and contraction, and the change in the number of bacteria after 18 hours was examined, and the arithmetic mean of the number of viable bacteria was determined.

As the test bacterial liquid, a bacterial liquid of *Staphylococcus aureus* was used.

[Wearing Comfort of Fabric]

From the fabrics of Examples 1 to 23 and Comparative Examples 1 to 10, undershirt (each fabric 100%) was manufactured by sewing, and the "wearing comfort" was evaluated by 10 subjects according to the following evaluation criteria.

Evaluation Criteria

1: Extremely excellent in comfort
2: Excellent in comfort
3: Comfort is normal
4: Poor comfort
5: Very poor comfort The average scores of the evaluation results by the 10 subjects are shown in Tables 1 to 3 below.

TABLE 1

| Example fabric | Yarn | Texture | Knitting machine | CPI | WPI | Basis weight g/m$^2$ | Test force N |
|---|---|---|---|---|---|---|---|
| 1 | B | Smooth | Double 28G | 40 | 40 | 200 | 10.0 |
| 2 | A | Plain stitch | Single 46G | 71 | 51 | 91 | 26.8 |
| 3 | A | Plain stitch | Single 46G | 83 | 61 | 115 | 59.3 |
| 4 | A | Takeup small knit: tack =1:1 | Single 46G | 50 | 42 | 102 | 10.0 |
| 5 | B | Bare plain stitch | Single 28G | 130 | 70 | 250 | 5.0 |
| 6 | C | Smooth | Double 28G | 50 | 50 | 160 | 25.0 |
| 7 | B | Moss stitch | Double 28G | 40 | 40 | 180 | 10.0 |
| 8 | B:L 1:1 | Smooth | Double 28G | 50 | 50 | 160 | 25.0 |
| 9 | D | Smooth | Double 28G | 40 | 40 | 250 | 15.0 |
| 10 | B | Honeycomb | Double 28G | 53 | 48 | 195 | 10.1 |

| Example fabric | Component A | Component B | Component C | Component D | Component E | Parameter X | Antibacterial activity value | Wearing comfort |
|---|---|---|---|---|---|---|---|---|
| 1 | 70.0 | 0.0 | 248.0 | 0.05 | 1.5 | 1302 | 2.23 | 2.1 |
| 2 | 71.0 | 0.0 | 561.3 | 0.29 | 1.5 | 17336 | 3.13 | 2.4 |
| 3 | 66.5 | 0.0 | 784.8 | 0.52 | 1.5 | 40708 | 5.65 | 2.4 |
| 4 | 70.0 | 43.7 | 325.5 | 0.10 | 1.5 | 5551 | 3.06 | 2.3 |
| 5 | 70.0 | 0.0 | 1410.5 | 0.02 | 1.5 | 2962 | 2.30 | 1.7 |
| 6 | 70.0 | 0.0 | 387.5 | 0.16 | 1 | 4340 | 2.60 | 1.9 |
| 7 | 70.0 | 30.0 | 248.0 | 0.06 | 1.5 | 2232 | 2.40 | 2.1 |
| 8 | 70.0 | 0.0 | 387.5 | 0.16 | 0.8 | 3472 | 2.30 | 1.8 |
| 9 | 70.0 | 0.0 | 248.0 | 0.06 | 3 | 3125 | 2.45 | 2.2 |
| 10 | 70.0 | 30.0 | 394.3 | 0.05 | 1.5 | 2957 | 2.63 | 1.9 |

TABLE 2

| Example fabric | Yarn | Texture | Knitting machine | CPI | WPI | Basis weight g/m$^2$ | Test force N |
|---|---|---|---|---|---|---|---|
| 11 | D | Honeycomb | Double 22G | 42 | 33 | 245 | 31.7 |
| 12 | B | Plain stitch | Single 28G | 63 | 67 | 129 | 31.0 |
| 13 | B | Smooth | Double 28G | 55 | 49 | 173 | 21.0 |
| 14 | B | Front moss | Single 46G | 76 | 59 | 149 | 38.0 |
| 15 | B | Front moss | Single 28G | 57 | 41 | 147 | 32.0 |
| 16 | B | Moss stitch | Double 28G | 56 | 47 | 192 | 27.0 |
| 17 | B | Knit miss | Single 28G | 38 | 75 | 138 | 26.0 |
| 18 | D | Knit miss | Single 24G | 38 | 43 | 175 | 31.0 |
| 19 | D | Back moss | Single 24G | 30 | 33 | 162 | 60.0 |
| 20 | B | Front moss | Single 28G | 51 | 51 | 106 | 31.8 |
| 21 | B | Back moss | Single 28G | 34 | 43 | 105 | 17.9 |

TABLE 2-continued

| | | | | | | | |
|---|---|---|---|---|---|---|---|
| 22 | D<br>F | Plating plain stitch | 200N<br>Sock knitting | 27 | 26 | 250 | 20.0 |
| 23 | N<br>F | Plating plain stitch | 200N<br>Sock knitting | 29 | 27 | 270 | 18.0 |

| Example fabric | Component A | Component B | Component C | Component D | Component E | Parameter X | Antibacterial activity value | Wearing comfort |
|---|---|---|---|---|---|---|---|---|
| 11 | 70.0 | 30.0 | 214.8 | 0.13 | 3 | 8377 | 2.8 | 1.9 |
| 12 | 70.0 | 0.0 | 654.3 | 0.24 | 1.5 | 16488 | 3.44 | 2.2 |
| 13 | 70.0 | 0.0 | 417.7 | 0.12 | 1.5 | 5263 | 2.69 | 1.8 |
| 14 | 70.0 | 45.0 | 695.0 | 0.26 | 1.5 | 31171 | 3.92 | 1.9 |
| 15 | 70.0 | 45.0 | 362.2 | 0.22 | 1.5 | 13745 | 3.01 | 1.8 |
| 16 | 70.0 | 30.0 | 408.0 | 0.14 | 1.5 | 8568 | 3.42 | 1.9 |
| 17 | 70.0 | 0.0 | 441.8 | 0.19 | 1.5 | 8814 | 3.12 | 1.6 |
| 18 | 70.0 | 0.0 | 253.3 | 0.18 | 3 | 9575 | 3.18 | 1.5 |
| 19 | 70.0 | 30.0 | 153.5 | 0.37 | 3 | 17039 | 4.23 | 1.9 |
| 20 | 70.0 | 45.0 | 403.2 | 0.30 | 1.5 | 20866 | 4.45 | 1.9 |
| 21 | 70.0 | 30.0 | 226.6 | 0.17 | 1.5 | 5778 | 2.83 | 2.0 |
| 22 | 70.0 | 0.0 | 108.8 | 0.08 | 3 | 1828 | 2.31 | 2.4 |
| 23 | 70.0 | 0.0 | 121.4 | 0.07 | 2 | 1190 | 2.28 | 1.5 |

TABLE 3

| Comparative Example fabric | Yarn | Texture | Knitting machine | CPI | WPI | Basis weight g/m$^2$ | Test force N |
|---|---|---|---|---|---|---|---|
| 1 | B | Smooth | Double 24G | 35 | 35 | 200 | 10.0 |
| 2 | D | Smooth | Double 24G | 30 | 30 | 250 | 8.0 |
| 3 | G | Smooth | Double 28G | 50 | 50 | 160 | 25.0 |
| 4 | G<br>M | Smooth | Double 28G | 50 | 50 | 160 | 25.0 |
| 5 | H | Honeycomb | Double 28G | 55 | 55 | 200 | 10.1 |
| 6 | G<br>M | Front moss | Single 46G | 75 | 60 | 180 | 20.0 |
| 7 | I | Honeycomb | Double 22G | 40 | 35 | 250 | 30.0 |
| 8 | K | Smooth | Double 28G | 52 | 52 | 155 | 25.0 |
| 9 | K | Honeycomb | Double 28G | 55 | 55 | 200 | 10.1 |
| 10 | N<br>J | Plating plain stitch | 200N<br>Sock knitting | 27 | 26 | 250 | 20.0 |

| Comparative Example fabric | Component A | Component B | Component C | Component D | Component E | Parameter X | Anti-bacterial activity value | Wearing comfort |
|---|---|---|---|---|---|---|---|---|
| 1 | 70.0 | 0.0 | 189.9 | 0.05 | 1.5 | 997 | 1.2 | 1.8 |
| 2 | 70.0 | 0.0 | 139.5 | 0.03 | 1.5 | 439 | 1.0 | 2.4 |
| 3 | 70.0 | 0.0 | 387.5 | 0.16 | 0.1 | 434 | 0.5 | 1.5 |
| 4 | 70.0 | 0.0 | 387.5 | 0.16 | 0.05 | 217 | 0.25 | 1.3 |
| 5 | 70.0 | 30.0 | 468.9 | 0.05 | 0.1 | 234 | 0.25 | 1.9 |
| 6 | 70.0 | 45.0 | 697.5 | 0.11 | 0.05 | 441 | 0.51 | 1.4 |
| 7 | 70.0 | 30.0 | 217.0 | 0.12 | 0.1 | 260 | 0.25 | 1.3 |
| 8 | 70.0 | 0.0 | 419.1 | 0.16 | 0.1 | 469 | 0.36 | 1.9 |
| 9 | 70.0 | 30.0 | 468.9 | 0.05 | 0.1 | 234 | 0.18 | 2.3 |
| 10 | 70.0 | 0.0 | 108.8 | 0.08 | 0.05 | 30 | 0.04 | 1.3 |

The fabrics of the present disclosure (Examples 1 to 23) all have parameter X of 1,000 or more.

On the other hand, all of the fabrics of Comparative Examples 1 to 10 had a parameter X of less than 1,000, and were found to be poor in antibacterial properties.

[Fiber Product]

Fiber product A: undershirt

The fabric of Example 1 was disposed under the armpit of the undershirt, and TWINCOT UV 25250 (manufactured by Asahi Kasei Fibers Limited) (longitudinal ratio of expansion and contraction 74.5%, lateral ratio of expansion and contraction 92.4%) was disposed as a second fabric in the other part, and a fiber product A (undershirt) was produced by sewing.

Fiber Product B: Sock

A sock with a plating plain stitch texture using a yarn (D): PLA 170 T 144 DTY (manufactured by Teijin Limited) as a front yarn and a yarn (F): PLA FTY (PLA 84 T 72 DTY/PU 44 T1) (manufactured by Teijin Limited) (Using PU 44 T1 (manufactured by Asahi Kasei Corporation) as a core yarn, a covering yarn of PLA 84 T 72 DTY was produced using an Italian twisting machine) as a back yarn was knitted using a sock knitting machine (200 N).

Fiber Product C: Sock

A sock with a plating plain stitch texture in which a yarn (M): a 60 count cotton spun yarn was used as a front yarn and a yarn (F) was used as a back yarn was knitted using a sock knitting machine (200 N).

[Ratio of Expansion and Contraction]

The ratio of expansion and contraction of the fabric was determined on the basis of JIS L 1096.

(1) Strip-shaped samples (about 300 mm (length)×about 50 mm (width)) are taken in each of the longitudinal direction (wale direction) and the lateral direction (course direction) of the fabric.

(2) The sample is clamped with a clamp of a tensile tester (distance between clamps: 200 mm).

(3) The sample is pulled at a rate of 200 mm/min.

(4) The maximum elongation of the sample is measured.

(5) The ratio of expansion and contraction is determined.

[Wearing Comfort of Fiber Product]

When the fiber products A to C were evaluated by 10 subjects according to the evaluation criteria of wearing comfort described above, the average points of the evaluation results were all "2 or less", and it was found that excellent wearing comfort was exhibited.

The fiber products A to C satisfy the parameter X, and thus have antibacterial properties.

The present invention is not limited to the above embodiments, and may be appropriately changed as necessary within the scope of the present disclosure.

The fabric and fiber product of the present disclosure exhibit antibacterial properties and wearing comfort, and thus can be suitably used in fiber products such as clothes, for example, undershirt, socks, underwear, shirts, sportswear, supporters, and the like. In particular, the fabric of the present disclosure can be used in a portion where bacteria are likely to propagate or a portion that is a source of odor, in particular, an armpit portion of undershirt or a shirt, a sole portion of a sock, or the like.

In addition, since the fabric and fiber product of the present disclosure exhibit antibacterial properties and wearing comfort, the fabric and fiber product can also be used for medical supplies such as bandages, gauzes, masks, and clothes for doctors and patients.

Alternatively, the fabrics and fiber products of the present disclosure may also be used in all product fields, for example, handkerchiefs, towels, footwear (for example, shoes, insoles for boots, and the like), hats, beddings (for example, bedclothes, mattresses, sheets, pillows, pillows covers, and the like), stuffed animals, pet-related products (for example, mats for pets, clothing for pets, inners for clothing for pets, and the like), various mat products (for example, mats for feet and mats for toilets, and the like), curtains, kitchen utensils (for example, sponges, cloths, and the like), seats (for example, seats of cars, trains, airplanes, and the like), sofas, sanitary products, sporting goods, and the like.

DESCRIPTION OF REFERENCE SIGNS

1: Yarn
20: Loop
21: Needle part
22: Sinker part
23: Intermediate part
30: Loop (with tuck)
31: Needle part (with tuck)
32: Sinker part (with tuck)
33: Intermediate part (with tuck)
100, 200, 300: Fiber product
101, 201, 301: First fabric
102, 202, 302: Second fabric

What is claimed is:

1. A fabric comprising:

a loop of a yarn comprising a potential generating filament, wherein the fabric has a value of X of 1,000 or more, where:

$$X=(A+B)\times C\times D\times E$$

wherein:

A is a loop angle of the loop of the yarn when the fabric is stretched by 10%,

B is a connection angle of the loop of the yarn when the fabric is stretched by 10%, C is a number of the loops of the yarn per 1 $cm^2$ of the fabric, D is a force (N) applied per basis weight ($g/m^2$) of the fabric, and E is a surface potential (V) of the yarn, and wherein the loop angle is larger than 0° and smaller than 90°, the connection angle is 0° to 75°, the number of the loops of the yarn per 1 $cm^2$ of the fabric is 100 to 1500, the force (N) applied per basis weight ($g/m^2$) of the fabric is 0.01 to 1.2, the surface potential (V) of the yarn is 0.1 V or more, and an antibacterial activity value is 2.2 or more.

2. The fabric according to claim 1, wherein the value of X is 100,000 or less.

3. The fabric according to claim 1, wherein the potential generating filament comprises a piezoelectric material.

4. The fabric according to claim 3, wherein the piezoelectric material comprises a polylactic acid.

5. The fabric according to claim 1, wherein the fabric is a knitted fabric.

6. The fabric according to claim 1, wherein the fabric has an antibacterial property.

7. The fabric according to claim 1, wherein the fabric has a wearing comfort.

8. A fiber product comprising:

a first fabric; and a second fabric, wherein the first fabric comprises a loop of a yarn containing a potential generating filament, wherein the first fabric has a value of X of 1,000 or more, where:

$$X=(A+B)\times C\times D\times E$$

wherein:

A is a loop angle of the loop of the yarn when the fabric is stretched by 10%,

B is a connection angle of the loop of the yarn when the fabric is stretched by 10%, C is number of the loops of the yarn per 1 $cm^2$ of the fabric, D is a force (N) applied per basis weight ($g/m^2$) of the fabric, and E is a surface potential (V) of the yarn, and wherein the second fabric has a stretchability, and wherein the loop angle is larger than 0° and smaller than 90°, the connection angle is 0° to 75°, the number of the loops of the yarn per 1 $cm^2$ of the fabric is 100 to 1500, the force (N) applied per basis weight ($g/m^2$) of the fabric is 0.01 to 1.2, and the surface potential (V) of the yarn is 0.1 V or more, and an antibacterial activity value is 2.2 or more.

9. The fiber product according to claim 8, wherein the second fabric has a higher stretchability than the first fabric.

10. The fiber product according to claim 8, wherein the second fabric has a stretch ratio of 40% or more in a first direction and a stretch ratio of 40% or more in a second direction perpendicular to the first direction.

11. The fiber product according to claim 8, wherein the first fabric has an antibacterial property and a wearing comfort.

12. The fiber product according to claim 8, wherein the second fabric has a wearing comfort.

13. The fiber product according to claim 8, wherein the first fabric has a higher stretchability than the second fabric.

14. The fiber product according to claim 13, wherein the first fabric has an antibacterial property.

15. The fiber product according to claim 8, wherein the second fabric comprises a yarn containing a potential generating filament.

16. The fiber product according to claim 15, wherein the second fabric has an antibacterial property.

17. The fiber product according to claim 8, wherein the fiber product is in the form of clothes selected from the group consisting of undershirt, socks, underwear, shirts, sportswear and supporters.

18. The fiber product according to claim 8, wherein the fiber product is in the form of medical supplies selected from the group consisting of undershirt, socks, underwear, shirts, sportswear and supporters.

* * * * *